United States Patent [19]

Morimoto et al.

[11] Patent Number: 5,011,763

[45] Date of Patent: Apr. 30, 1991

[54] METHOD FOR PROCESSING A SILVER HALIDE COLOR PHOTOGRAPHIC MATERIAL

[75] Inventors: Kiyoshi Morimoto; Yoshihiro Fujita, both of Kanagawa, Japan

[73] Assignee: Fuji Photo Film Co., Ltd., Kanagawa, Japan

[21] Appl. No.: 263,228

[22] Filed: Oct. 27, 1988

[30] Foreign Application Priority Data

Oct. 29, 1987 [JP] Japan ..... 62-274095
Nov. 2, 1987 [JP] Japan ..... 62-277580

[51] Int. Cl.[5] ..... G03C 7/00; G03C 7/42

[52] U.S. Cl. ..... 430/393; 430/430; 430/460; 430/461

[58] Field of Search ..... 430/393, 430, 460, 461

[56] References Cited

U.S. PATENT DOCUMENTS 4,596,764 6/1986 Ishimaru ..... 430/393
4,745,048 5/1988 Kishimoto et al. ..... 430/376
4,756,918 7/1988 Ueda et al. ..... 430/393
4,804,618 2/1989 Ueda et al. ..... 430/393

FOREIGN PATENT DOCUMENTS 63-261362 10/1988 Japan .

OTHER PUBLICATIONS

English Abstract of Jap. Pat. No. 63-261362 Oct. 28, 1988.

Ueda et al., "Processing Method for Silver Halide Color Photographic Sensitive Material".

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A method for processing a silver halide color photographic material is disclosed, comprising after development, bleaching or bleach-fixing an imagewise exposed silver halide color photographic material in the presence of at least one compound represented by formula (I):

(I)

wherein $R^1$ and $R^2$, which may be the same or different, each represents a hydrogen atom or an alkyl group, or $R^1$ and $R^2$ may combine with each other to form a heterocyclic ring; $A^1$ and $A^2$, which may be the same or different, each represents an alkylene group having from 2 to 5 carbon atoms which may be substituted; and n represents an integer from 2 to 6.

In accordance with the method of the present invention, as a result of accelerated bleaching function, the processing time is shortened while sufficient bleaching is performed, thus providing color photographic images of excellent image quality.

14 Claims, No Drawings

METHOD FOR PROCESSING A SILVER HALIDE COLOR PHOTOGRAPHIC MATERIAL

FIELD OF THE INVENTION

The present invention relates to a method for processing an exposed silver halide color photographic material (hereinafter referred to as a color light-sensitive material). More particularly, the present invention relates to an improved processing method which accelerates the bleaching function, thus shortening the processing time while conducting sufficient bleaching, and provides a color photographic image of excellent image quality.

BACKGROUND OF THE INVENTION

The fundamental steps of processing color light-sensitive materials generally include a color developing step and a silver removing step (e.g., bleaching step, bleach-fixing step, etc.). Thus, an imagewise exposed silver halide color photographic material undergoes a color developing step, where silver halide is reduced with a color developing agent to produce silver and the oxidized color developing agent in turn reacts with a color former to yield a dye image. Subsequently, the color photographic material undergoes a silver removing-step, where silver produced in the developing step is oxidized with an oxidizing agent (usually called a bleaching agent), and is dissolved away with a silver ion complexing agent, usually called a fixing agent. Therefore, only a dye image is formed in the thus processed photographic material. In addition to the above described two fundamental steps of color development and silver removal, actual development processing involves auxiliary steps for maintaining the photographic and physical quality of the resulting image or for improving the preservability of the image. Some examples of these auxiliary steps include a hardening bath for preventing a light-sensitive layer from being excessively softened during photographic processing, a stopping bath for effectively stopping the developing reaction, an image stabilizing bath for stabilizing the image, and a layer removing bath for removing the backing layer on the support.

The above described silver removal step may be conducted in two basic ways: one way uses two steps individually employing a bleaching bath and a fixing bath; and the other way is more simple and is conducted in one step employing a bleach-fixing bath containing both a bleaching agent and a fixing agent for the purpose of accelerating the processing and elimination of labor.

In recent years, bleach processing using a ferric ion complex salt (for example, aminopolycarboxylic acid ferric ion complex salt, particularly iron (III) ethylenediaminetetraacetate complex salt) as a major bleaching component has mainly been employed in processing color photographic light-sensitive materials in view of the acceleration and simplification of the bleaching provided and the need to prevent environmental pollution.

However, ferric ion complex salts have a comparatively low oxidizing power and, therefore, have generally insufficient bleaching power. A bleaching or bleach-fixing solution containing such a complex salt as a bleaching agent can attain some desirable objects when bleaching or bleach-fixing a low speed silver halide color photographic light-sensitive material containing, for example, a silver chlorobromide emulsion as a major component. However, such a solution provides insufficient desilveration due to insufficient bleaching power or requires a long time to bleach when processing a high speed, spectrally sensitized silver halide color photographic light-sensitive material containing a silver chlorobromoiodide emulsion or a silver iodobromide emulsion as a major component, particularly color reversal light-sensitive materials for photography or color negative light sensitive materials for photography comprising an emulsion containing a larger amount of silver.

In the color light-sensitive materials, sensitizing dyes are generally employed for the purpose of spectral sensitization. In particular, when a silver halide emulsion containing a large amount of silver or tabular grains having a high aspect ratio is employed in order to achieve high sensitivity, a problem occurs in that sensitizing dyes adsorbed on the surfaces of silver halide grains interfere with the bleaching of silver formed during the development step.

Known bleaching agents, other than ferric ion complex salts, include persulfates. Persulfates are usually used in a bleaching solution together with a chloride. However, this type of persulfate-containing bleaching solution has less bleaching ability than ferric ion complex salts, thus requiring a substantially long period of time for bleaching.

As described above, bleaching agents which do not cause environmental pollution or corrode vessels and apparatus usually have only a weak bleaching power. Hence, it is desired to enhance the bleaching power of a bleaching solution or a bleach-fixing solution containing a weak bleaching agent, particularly a ferric ion complex salt or a persulfate.

In order to increase the bleaching power of a bleaching solution or a bleach-fixing solution containing a ferric ion complex salt such as iron (III) ethylenediaminetetraacetate as a bleaching agent, it has been heretofore proposed to add various bleach accelerating agents to the processing bath.

Examples of such bleach accelerating agents include various mercapto compounds as described, for example, in U.S. Pat. No. 3,893,858, British Patent 1,138,842 and JP-A-53-141623 (the term "JP-A" as used herein means an "unexamined published Japanese patent application"), compounds having a disulfide bond as described, for example, in JP-A-53-95630, thiazolidine derivatives as described, for examples, in JP-B-53-9854 (the term "JP-B" as used herein means an "examined Japanese patent publication), isothiourea derivatives as described, for example, in JP-B-53-94927, thiourea derivatives as described, for example, in JP B-45-8506 and JP-B-49-26506, thioamide compounds as described, for example, in JP-A-49-42349, and dithiocarbamates as described, for example, in JP-A-55-26506.

Among these bleach accelerating agents, although some compounds certainly exhibit a bleach accelerating function, their effects are not always sufficient. Further, these compounds are extremely unstable in a processing solution, particularly in a bleach-fixing solution and lose their effects in a short period of time. Therefore, they are not always suitable for practical use.

Other bleach accelerating agents, for example, onium compounds as described, for example, in U.S. Pat. No. 3,748,136, phenylene linking ammonium salts as described, for example, in JP-B-54-12056, and amine compounds as described, for example, in U.S. Patent 4,552,834 are also known. However, these compounds have only weak bleach accelerating effects and they are not always suitable for practical use, although they are stable in a bleaching solution or a bleach-fixing solution.

Moreover, the compounds as described in JP-B-60-24936 do not always show a satisfactory bleach accelerating effect, although they do exhibit a certain degree of bleach accelerating effect. Further, they often form stains in the case of continuous processing.

As described above, many of these bleach accelerating agents do not always show a satisfactory bleach accelerating effect, and some of them lack stability in the processing solution although they exhibit an excellent bleach accelerating effect. Therefore, they provide a processing solution having only a short effective life or which cannot be stored for a long time.

The above-mentioned compounds as described in JP-B-60-24936 show a certain degree of bleach accelerating effect and are capable of being stored for a relatively long period of time. However, such compounds, as noted, still have a problem in that they often form stains on the photographic material thus-processed.

SUMMARY OF THE INVENTION

An object of the present invention is, therefore, to provide a method for processing a color photographic light-sensitive material which does not release environmentally harmful materials, which meets the requirement of preventing environmental pollution and which has excellent bleaching speed.

Another object of the present invention is to provide a processing method involving a bleaching or bleach-fixing step in which enhanced bleaching power is attained without deteriorating other photographic properties, using a bleaching agent having a weak bleaching power, in particular, a ferric ion complex salt or a persulfate.

A further object of the present invention is to provide a bleaching process for a color photographic light-sensitive material which uses a bleaching or bleach-fixing solution showing increased bleaching speed and having excellent stability.

A still further object of the present invention is to provide a processing method which can rapidly bleach or bleach-fix a color photographic light-sensitive material having photographing speed.

Yet another object of the present invention is to provide a method which can rapidly bleach or bleach-fix a color photographic light-sensitive material without the formation of stains on the photographic material thus-processed.

Other objects and advantages of the present invention will become apparent from the following description and examples.

These and often objects and advantages of the present invention are attained by a method for processing a silver halide color photographic material comprising after development, bleaching or bleach-fixing an imagewise exposed silver halide color photographic material in the presence of at least one compound represented by formula (I):

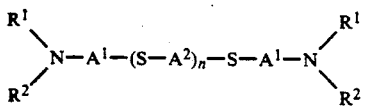

$$R^1R^2N-A^1-(S-A^2)_n-S-A^1-NR^1R^2 \quad (I)$$

wherein $R^1$ and $R^2$, which may be the same or different, each represents a hydrogen atom or an alkyl group, or $R^1$ and $R^2$ may combine with each other to form a heterocyclic ring; $A^1$ and $A^2$, which may be the same or different, each represents an alkylene group having from 2 to 5 carbon atoms which may be substituted; and n represents an integer from 2 to 6.

DETAILED DESCRIPTION OF THE INVENTION

The method according to the present invention comprises subjecting an imagewise exposed silver halide color photographic material to color development, then to bleaching and fixing or, alternatively, to bleach-fixing.

The compounds represented by formula (I) are described in detail below.

In formula (I), $R_1$ and $R_2$, which may be the same or different, each represents a hydrogen atom or an alkyl group. The alkyl group is preferably an unsubstituted alkyl group having preferably from 1 to 10 carbon atoms, particularly preferably from 1 to 5 carbon atoms. Alternatively, $R_1$ and $R_2$ may combine with each other to form a heterocyclic ring. The heterocyclic group thus-formed includes, for example, a piperidyl group, a pyrrolidinyl group, a morpholino group, a imidazolinyl group, a pyrazolinyl group, and an indolinyl group. These heterocyclic groups have preferably from 1 to 10 carbon atoms and more preferably from 1 to 5 carbon atoms.

$A^1$ and $A^2$, which may be the same or different, each represents an alkylene group having generally from 2 to 5 carbon atoms and preferably from 2 to 4 carbon atoms, which may be substitued. Suitable examples of the substituent for the alkylene group include a hydroxyl group, an amino group and a carboxyl group. Specific examples of the alkylene group represented by $A^1$ or $A^2$ include ethylene, propylene, trimethylene, tetramethylene, pentamethy lene, 2 -hydroxytrimethyle ne, a nd aminotrimethylene. Ethylene and trimethylene are preferred.

n represents an integer from 2 to 6 and preferably is 2 or 3 in view of prevention of deposition of the compound at room temperature. When n is 7 or more, a problem of decrease in solubility may occur and it is not preferred to use such compounds in practice. On the other hand, when n is 1 or less, such compounds are not preferred in view of their poorer bleach accelerating ability. The $(S-A^2)$ moiety in formula (I) represents a repeating unit and the groups represented by $A^2$ in this repeating unit may be the same or different in the same compound.

The compound represented by formula (I) used in the present invention as a bleach accelerating agent can be incorporated only into either a bleaching solution, a bleach-fixing solution (including replenishers thereof) or a prebath thereof. Alternatively, the compound can be previously incorporated into the color light-sensitive material and then introduced into a bleaching solution or a bleach-fixing solution. The amount of the compound added to the bleaching solution, bleach-fixing solution or prebath thereof is preferably from $1\times10^{-5}$ to $1\times10^{1}$ mol, more preferably from $1\times10^{-3}$ to $2\times10^{2}$ mol, and most preferably from $2\times10^{-3}$ to $1\times10^{-2}$ mol, per liter of the processing solution. When the compound is incorporated into the color light-sensitive material, the amount thereof is preferably from $1\times10^{-4}$ to $1\times10^{-2}$ mol, and more preferably from $2\times10^{-4}$ to $5\times10^{-3}$ mol, per $m^2$ of the color light-sensitive material.

The compound represented by formula (I) can be employed individually or as a combination of two or more thereof as the bleach accelerating agent.

An attempt of employing a thioether compound similar to the compound of the formula (I) used in the present invention as a bleach accelerating agent has been hitherto made as described in JP-B-60-24936. In JP-B-60-24986, although compounds having 2 to 3 thioether bonds are disclosed, the amino compounds described which, on superficial examination appear similar to the compounds according to the present invention, have only two thioether bonds.

On the contrary, the amino compounds according to the present invention are characterized by containing many (i.e., 3 to 7) thioether bonds and have distinctly superior bleach accelerating effect in comparison with the compounds as described in JP-B-60-24936. Further, the examples of amino compounds described in JP-B-60-24936 having two thioether bonds show a certain degree of bleach accelerating effect, but often form stains on the color photographic material when continuously processed. In contrast, the compounds according to the present invention have a very large bleach accelerating effect and do not cause stain on the photographic material processed.

The compounds according to the present invention exhibit an extraordinarily large bleach accelerating ability and are stable in the bleaching solution or the bleach-fixing solution. Therefore, they are satisfactorily applicable to continuous processing for a long period of time using an automatic developing machine as conventionally practiced.

Specific examples of the compounds represented by formula (I) used in the present invention are set forth below but the present invention should not be construed as being limited thereto.

$H_2N(CH_2)_2S(CH_2)_2S(CH_2)_2S(CH_2)_2NH_2$ (1)

$H_2N(CH_2)_2S(CH_2)_2S(CH_2)_2S(CH_2)_2S(CH_2)_2NH_2$ (2)

$H_2N(CH_2)_3S(CH_2)_2S(CH_2)_2S(CH_2)_3NH_2$ (3)

$H_2N(CH_2)_3S(CH_2)_2S(CH_2)_2S(CH_2)_2S(CH_2)_3NH_2$ (4)

$H_2N(CH_2)_2S(CH_2)_2S(CH_2)_3S(CH_2)_2S(CH_2)_2NH_2$ (5)

$H_2N(CH_2)_3S(CH_2)_2S(CH_2)_3S(CH_2)_2S(CH_2)_3NH_2$ (6)

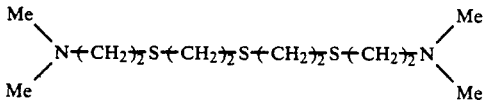
(7)

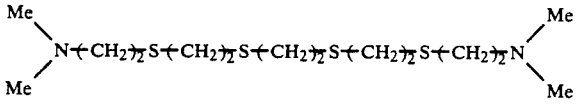
(8)

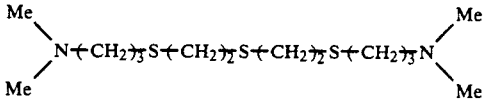
(9)

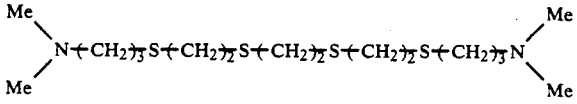
(10)

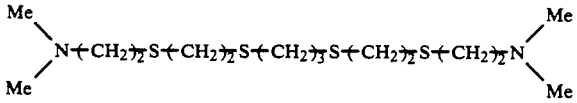
(11)

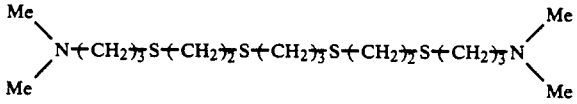
(12)

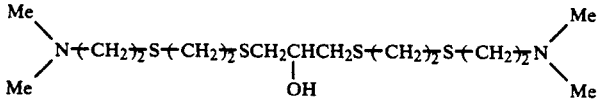
(13)

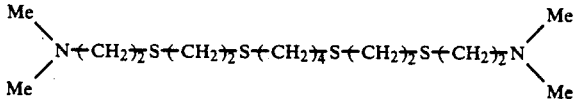
(14)

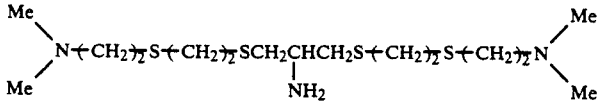
(15)

-continued $(C_2H_5)_2N(CH_2)_2S(CH_2)_2S(CH_2)_2S(CH_2)_2N(C_2H_5)_2$ (16)

$(C_2H_5)_2N(CH_2)_3S(CH_2)_2S(CH_2)_2S(CH_2)_3N(C_2H_5)_2$ (17)

$(C_2H_5)_2N(CH_2)_2S(CH_2)_2S(CH_2)_3S(CH_2)_2S(CH_2)_2N(C_2H_5)_2$ (18)

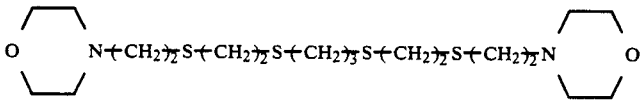
(19)

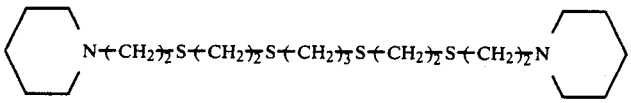
(20)

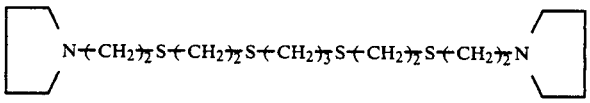
(21)

$(i\text{-}C_3H_7)_2N(CH_2)_2S(CH_2)_2S(CH_2)_2S(CH_2)_2N(i\text{-}C_3H_7)_2$ (22)

$(n\text{-}C_4H_9)_2N(CH_2)_2S(CH_2)_2S(CH_2)_2S(CH_2)_2N(n\text{-}C_4H_9)_2$ (23)

$(C_2H_5)_2N(CH_2)_2S(CH_2)_2SCH_2CH(OH)CH_2S(CH_2)_2S(CH_2)_2N(C_2H_5)_2$ (24)

$(C_2H_5)_2N(CH_2)_2S(CH_2)_2SCH_2CH(COOH)S(CH_2)_2S(CH_2)_2N(C_2H_5)_2$ (25)

$H_2N(CH_2)_2S(CH_2)_2S(CH_2)_2S(CH_2)_2S(CH_2)_2S(CH_2)_2S(CH_2)_2NH_2$ (26)

$(CH_3)_2N(CH_2)_2S(CH_2)_2S(CH_2)_2S(CH_2)_2S(CH_2)_2S(CH_2)_2N(CH_3)_2$ (27)

$(C_2H_5)_2N(CH_2)_2S(CH_2)_2S(CH_2)_2S(CH_2)_2S(CH_2)_2S(CH_2)_2N(C_2H_5)_2$ (28)

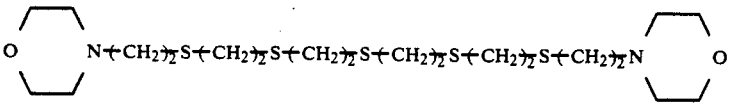
(29)

$H_2N(CH_2)_2S(CH_2)_2S(CH_2)_2S(CH_2)_2S(CH_2)_2S(CH_2)_2S(CH_2)_2NH_2$ (30)

$H_2N(CH_2)_2S(CH_2)_2S(CH_2)_2S(CH_2)_3S(CH_2)_2S(CH_2)_2S(CH_2)_2NH_2$ (31)

-continued $H_2N(CH_2)_3S(CH_2)_2S(CH_2)_2S(CH_2)_3S(CH_2)_2S(CH_2)_2S(CH_2)_3NH_2$ (32)

$H_2N(CH_2)_2S(CH_2)_2S(CH_2)_2S(CH_2)_4S(CH_2)_2S(CH_2)_2S(CH_2)_2NH_2$ (33)

$H_2N(CH_2)_2S(CH_2)_2S(CH_2)_2S(CH_2)_5S(CH_2)_2S(CH_2)_2S(CH_2)_2NH_2$ (34)

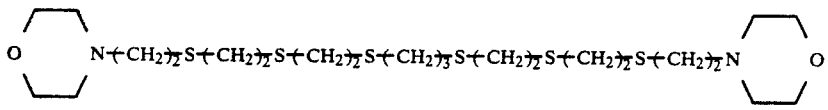
(35)

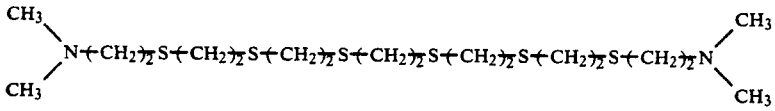
(36)

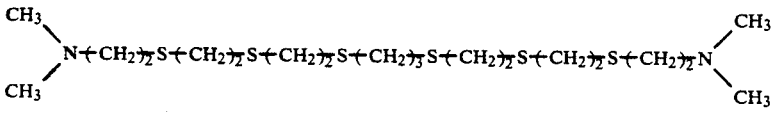
(37)

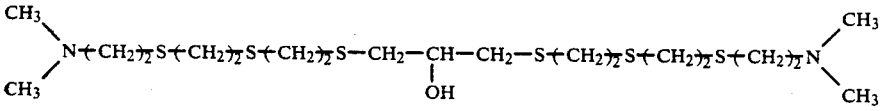
(38)

$H_2N(CH_2)_2S(CH_2)_2S(CH_2)_2S(CH_2)_2S(CH_2)_2S(CH_2)_2S(CH_2)_2S(CH_2)_2NH_2$ (39)

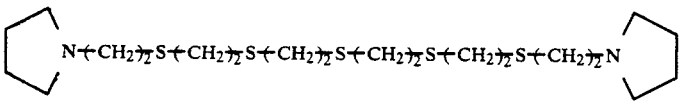
(40)

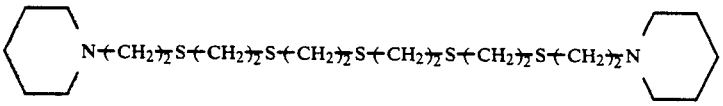
(41)

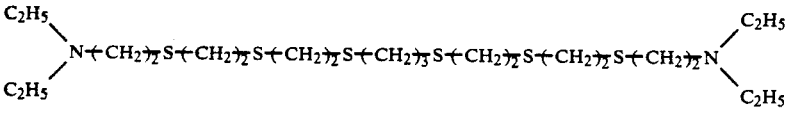
(42)

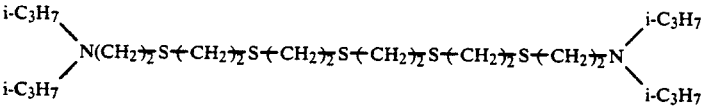
(43)

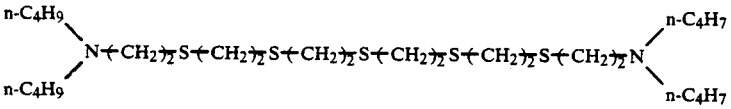
(44)

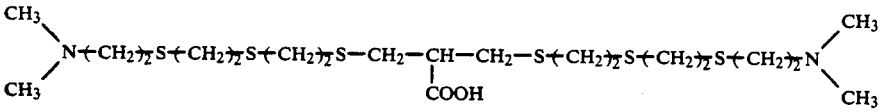
(45)

The compounds according to the present invention can be easily synthesized with reference to methods generally well known. Specific methods for synthesis of the compounds are illustrated below. The percentage of solution is by weight.

SYNTHESIS OF COMPOUND (1)

To 150 ml of ethanol were added 11.8 g of bismercaptoethylsulfide and 17.8 g of 2-chloroethylamine hydrochloride, to the mixture was added 59.2 g of a 28% methanol solution of sodium methoxide under a nitrogen atmosphere and then the mixture was refluxed by heating for 3 hours. After removing the resulting inorganic salt by filtration, to the filtrate were added 25 ml of a 25% ethanol solution of hydrogen chloride and then 200 ml of ethyl acetate. The crystals thus-deposited were collected by filtration and recrystallized from a mixture of 300 ml of methanol and 200 ml of ethyl acetate to obtain compound (1) as dihydrochloride. Yield 17.5 g (73%).

SYNTHESIS OF COMPOUND (11)

To 150 ml of an ethanol solution containing 5 g of 1, 4, 8, 11-tetrathiaundecane which was synthesized by the method as described in *J. Am. Chem. Soc.*, Vol. 91, page 4694(1969) and 6.3 g of dimethylaminoethyl chloride hydrochloride, was added 17 g of a 28% methanol solution of sodium methoxide under a nitrogen atmosphere and the mixture was refluxed by heating for 3 hours. After removing the resulting inorganic salt by filtration, to the filtrate were added 15 ml of a 25% ethanol solution of hydrogen chloride and then added 200 ml of ethyl acetate. The crystals thus-deposited were collected by filtration and recrystallized from a mixture of 100 ml of ethanol and 250 ml of ethyl acetate to obtain compound (11) as dihydrochloride. Yield: 5.5 g(55%).

SYNTHESIS OF COMPOUND (36)

1, 4, 7, 10, 13, 16 hexathiahexadecane was synthesized with reference to the method as described in *J. Am. Chem. Soc.*, Vol. 91, page 4694(1969). To a mixture of 10 g of the above-described compound, 75 ml of ethyl acetate and 75 ml of ethanol were added 23.3 g of a 28% methanol solution of sodium methoxide and then added 8.6 g of dimethylaminoethyl chloride hydrochloride under a nitrogen atmosphere and the mixture was refluxed by heating for 3 hours. 200 ml of water was added to the reaction mixture, extracted twice with chloroform, and the extract was concentrated under a reduced pressure. To the residue were added 100 g of methanol and 15 ml of a 25% ethanol solution of hydrogen chloride to obtain Compound (36) as dihydrochloride. Yield: 5.1 g(30%).

Other compounds can be synthesized in a similar manner.

The present invention exhibits its effects in any processing method wherein a bleaching bath, a bleach-fixing bath and a fixing bath are employed in combination as a desilvering step. Suitable examples of the desilvering steps are set forth below, but the present invention is not to be construed as being limited thereto.

No. 1 Bleaching—Fixing
No. 2 Bleaching—Washing with water—Fixing
No. 3 Bleaching—Bleach-fixing
No. 4 Bleaching—Bleach-fixing—Fixing
No. 5 Fixing—Bleach-fixing
No. 6 Bleach-fixing Of the above-described types of desilvering steps, No. 6 is most preferred.

Further, the desilvering step is ordinarily conducted after the development step, and a bath for washing with water or bleach acceleration may be provided between developing step and the desilvering step. It is preferred in view of a rapid processing that the desilvering step is carried out after immediately the development step.

Moreover, each processing step is preferably performed in an co-current or counter-current multistage processing system. Particularly, a two-stage or three-stage counter-current system is preferred.

Any known bleaching agent can be employed as a bleaching agent in the bleaching solution or bleach-fixing solution of the present invention. In particular, an aminopolycarboxylic acid-ferric complex salt or a persulfate is preferably employed in the bleaching solution, and an aminopolycarboxylic acid-ferric complex salt is preferably employed in the bleach-fixing bath. The aminopolycarboxylic acid-ferric complex salt is a complex of ferric ion and an aminopolycarboxylic acid or a salt thereof.

Representative examples of the aminopolycarboxylic acids are set forth below, but the present invention should not be construed as being limited thereto.

A-1 : Ethylenediaminetetraacetic acid
A-2 : Diethylenetriaminepentaacetic acid
A-3 : 1,3-Diaminopropanetetraacetic acid
A-4 : 1,2-Diaminopropanetetraacetic acid
A-5 : Ethylenediamine-N-(β-oxyethyl)-N,N',N'-triacetic acid
A-6 : Nitrilotriacetic acid
A-7 : 1,2-Cyclohexanediaminetetraacetic acid
A-8 : Iminodiacetic acid
A-9 : Dihydroxyethylglycine
A-10: Ethyl ether diaminetetraacetic acid
A-11: Glycol ether diaminetetraacetic acid
A-12: Ethylenediaminetetrapropionic acid Of these compounds, A-1 to A-3, A-7, A-8 and A-11 are particularly preferred.

The aminopolycarboxylic acid-ferric complex salt may be used in the form of a complex salt or may be formed in a solution by using an aminopolycarboxylic acid together with a ferric salt such as a ferric sulfate, ferric nitrate, ferric chloride, ferric ammonium sulfate and ferric phosphate. When the complex salt is used in the form of a complex salt, one, or two or more of the complex salts may be employed. On the other hand, when a complex salt is formed in the solution by using a ferric salt and an aminopolycarboxylic acid, one, or two or more ferric salts may be used. Further, one, or two or more aminopolycarboxylic acids may also be employed. In any case, it is preferred that an aminopolycarboxylic acid is used in an excess amount of what is necessary to form a ferric ion complex salt.

The aminopolycarboxylic acid and ferric complex salt thereof is preferably employed usually in the form of an alkali metal salt or an ammonium salt. Particularly, an ammonium salt thereof is preferred in view of the solubility.

Further, the bleaching solution or bleach-fixing solution containing the ferric ion complex according to the present invention may further contain metal ion complex salts other than iron ion complex salt, such as cobalt ion complex salt and copper ion complex salt.

Suitable examples of the persulfates used in the present invention include an ammonium salt, a potassium salt and a sodium salt thereof.

Furthermore, a compound conventionally known as a bleach accelerating agent can also be added to the bleaching solution, bleach-fixing solution or prebath thereof in addition to the bleach accelerating agent according to compounds represented by formula (I) of the present invention. Suitable examples of such bleach accelerating agents include compounds having a mercapto group or a disulfide bond as described, for example, in U.S. Pat. No. 3,893,858, German Patent 1,290,812, British Patent 1,138,842, JP-A-53-95630 and *Research Disclosure*, No. 17129 (July, 1978); thiazolidine derivatives as described in JP-A-50-140129; thiourea derivatives as described in U.S. Pat. No. 3,706,561, iodides as describe in JP-A-58-16235; polyethylene oxides as described in German Patent 2,748,430; and polyamine compounds as described in JP-B-45-8836. The mercapto compounds as described in British Patent 1,138,842 are particularly preferred.

These bleach accelerating agents can also be added to a bath preceding the processing solution having a bleaching ability according to the present invention.

In addition to the bleaching agent and the bleach accelerating compounds described above, the bleaching solution according to the present invention can contain rehalogenating agents, for example, bromides such as potassium bromide, sodium bromide and ammonium bromide and chlorides such as potassium chloride, sodium chloride and ammonium chloride. The amount of the rehalogenating agent is generally from 0.1 to 5 mol, preferably from 0.5 to 3 mol per liter of the bleaching solution.

Further, other additives that have a pH buffering ability and are known to be used generally in a bleaching solution can be employed. For example, one or more inorganic acids, organic acids and their salts such as nitrates (e.g., sodium nitrate and ammonium nitrate), boric acid, borax, sodium metaborate, acetic acid, sodium acetate, sodium carbonate, potassium carbonate, phosphorous acid, phosphoric acid, sodium phosphate, citric acid, sodium citrate and tartaric acid can be added to the solution.

In the present invention, when a bleaching solution is used, the amount of the bleaching agent is from 0.05 to 1 mol and preferably from 0.1 to 0.5 mol, per liter of the bleaching solution.

The pH of the bleaching solution is generally from 4.0 to 8.0 and preferably from 5.0 to 6.5 in case of using an aminopolycarboxylic acid-ferric complex salt and is generally from 0.5 to 8.0 and preferably from 2.0 to 4.0 in case of using a persulfate. The temperature of the bleaching solution is usually from 10 to 60° C., preferably from 30 to 50° C., and more preferably from 35 to 45° C. The amount of replenishment for the bleaching solution is generally from 50 to 2,000 ml and preferably from 100 to 500 ml, per $m^2$ of the color light-sensitive material.

In the present invention, when a bleach-fixing solution is used, the amount of the bleaching agent in the bleach-fixing solution is generally from 0.05 to 0.5 mol and preferably from 0.1 to 0.4 mol, per liter of the solution.

Further, in the bleach-fixing solution, thiosulfates such as sodium thiosulfate, ammonium thiosulfate, sodium ammonium thiosulfate and potassium thiosulfate; thiocyanates such as sodium thiocyanate, ammonium thiocyanate and potassium thiocyanate; thiourea; and thioethers are employed as fixing agents. The amount of the fixing agents used is generally from 0.3 to 3 mol and preferably from 0.5 to 2 mol, per liter of the bleach-fixing solution.

The bleach-fixing solution further may contain compounds which are added to the above bleaching solution in addition to the bleaching agents and the fixing agents as described above. The bleach-fixing solution can contain preservatives such as sulfites (e.g., sodium sulfite, potassium sulfite and ammonium sulfite), hydroxylamines, hydrazines and aldehyde compound-bisulfite adducts (e.g., acetaldehyde-sodium bisulfite adduct). Further, various fluorescent brightening agents, deforming agents, surface active agents, polyvinyl pyrrolidone, and organic solvents (e.g. methanol) may be added to the bleach-fixing solution.

The pH of the bleach-fixing solution is generally from 4.0 to 9.0, preferably from 5.0 to 8.0, and more preferably from 6.0 to 7.5. The preferred temperature of the bleach-fixing solution is the same as that described for the above bleaching solution.

The amount of replenishment for the bleach-fixing solution is preferably from 300 to 3,000 ml and more preferably from 300 to 1,000 ml, per m2 of the color light-sensitive material.

The compound represented by formula (I) according to the present invention can also be used in a method employing a bleaching-bleach fixing step as described in JP-A-61-75352. In such a case, the bleach accelerating compound may be added either to a bleaching solution, a bleach-fixing solution or to both.

In the processing method of the present invention, the fixing solution may contain any of compounds which are described above for the bleach-fixing solution.

The pH of the fixing solution is generally from 3.0 to 9.0 and preferably from 5.0 to 8.0, and the processing time is preferably from 20 sec. to 10 min. and more preferably from 30 sec. to 4 min. The amount of the fixing agent used and the preferred temperature of the fixing solution are same as those described for the above bleach-fixing solution.

When the bleaching, bleach-fixing or fixing step is directly followed by a water washing or stabilizing step, a part or all of over-flow solution therefrom is preferably introduced into the bleaching, bleach-fixing or fixing solution.

The color developing solution used in the present invention contains a known aromatic primary amine color developing agent. Preferred examples thereof are p-phenylenediamine derivatives. Typical examples of the p-phenylenediamine derivative used are set forth below, but the present invention should not be construed as being limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(α-hydroxyethyl)amino]aniline
D-5: 2-Methyl-4-[N-ethyl]N-(β-hydroxyethyl-)amino]aniline
D-6: 4-Amino-3-methyl-N-ethyl-N-[β-(methanesulfonamido)ethyl]aniline
D-7: N-(2-Amino-5-diethylaminophenylethyl)methanesulfonamide
D-8: N,N-Dimethyl-p-phenylenediamine
D-9: 4 Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-βbutoxyethylaniline Of these p-phenylenediamine derivatives, D-5 is particularly preferred.

These p-phenylenediamine derivatives may be in the form of salts such as sulfates, hydrochlorides, sulfites, or p-toluenesulfonates.

The aromatic primary amine developing agent is preferably used in an amount of generally from about 0.1 g to about 20 g and more preferably from about 0.5 g to about 10 g per liter of the developing solution.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

However, in order to increase the color forming property of the color developing solution, it is preferred that the color developing solution substantially does not contain sulfite ion. The term "substantially not contain" means that the color developing solution contains sulfite ion in an amount of 0.5 g or less and preferably 0.2 g or less calculated as sodium sulfite per liter of the solution. It is more preferred that the color developing solution does not contain sulfite ion at all.

Further, it is preferred to add, as compounds capable of directly preservating the color developing agent, various hydroxylamines, hydroxamic acids as described in JP-A-63-43138, hydrazines and hydrazides as described in European Patent 170,756, phenols as described in JP-A-63-44657 and JP-A-63-58443, α-hydroxyketones and α-aminoketones as described in JP-A-63-44656, and/or various saccharides as described in JP-A-63-36244 to the color developing solution. Moreover, together with the above described compounds, monoamines as described in JP-A-63-4235, JP-A-63-24254, JP-A-63-21647, JP-A-63-146040, JP-A-63-27841 and JP-A-63-25654; diamine as described in JP-A-63-30845, JP-A-63-146040 and JP-A-63-43139; polyamines as described in JP-A-63-21647 and JP-A-63-26655; polyamines as described in JP-A-63-44655, nitroxy radicals as described in JP-A-63-53551; alcohols as described in JP-A-63-43140 and JP-A-63-53549; oximes as described in JP-A-63-56654; and tertiary amines as described in European Patent 266,797 are preferably employed.

Other preservatives such as various metals as described in JP-A-57-44148 and JP-A-57-53749, salicylic acids as described in JP-A-59-180588, alkanolamines as described in JP-A-54-3532, polyethyleneimines as described in JP-A-56-94349, aromatic polyhydroxyl compounds as described in U.S. Pat. No. 3,746,544, etc. may be incorporated into the color developing solution, if desired. Particularly, the addition of aromatic polyhydroxy compounds is preferred.

The color developing solution used in the present invention has a pH which ranges preferably from 9 to 12 and more preferably from 9 to 11.0. The color developing solution may also contain any of the compounds that are known to be usable as components of conventional developing solutions.

In order to maintain the pH within the above-described range, various kinds of buffers are preferably employed. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter of the developing solution.

In addition, various chelating agents can be used in the color developing solution according to the present invention for the purpose of preventing calcium or magnesium precipitation or increasing the stability of the color developing solution.

As the chelating agents, organic acid compounds are preferred and include aminopolycarboxylic acids, organic phosphoric acids and phosphonocarboxylic acids.

Specific examples of useful chelating agents are set forth below, but the present invention should not be construed as being limited thereto.

Nitrilotriacetic acid
Diethylenetriaminepentaacetic acid
Ethylenediaminetetraacetic acid
N,N,N-Trimethylenephosphonic acid
Ethylenediamine-N,N,N',N'-tetramethylenephosphonoic acid
Trans-cyclohexanediaminetetraacetic acid
1,2-Diaminopropanetetraacetic acid
Hydroxyethyliminodiacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions being present therein. For example, a range of from about 0.1 g to about 10 g per liter of the color developing solution may be employed.

The color developing solution may contain appropriate development accelerators, if desired. However, it is preferred that the color developing solution used in the present invention does not substantially contain benzyl alcohol in view of prevention of environmental pollution, the easy preparation of the solution and prevention of color stain. The term "substantially not contain" means that the color developing solution contains benzyl alcohol in an amount of 2 ml or less per liter of the solution, and preferably does not contain benzyl alcohol at all.

Examples of suitable development accelerators include thioether type compounds as described in JP-B-37-16088, JP-B-37-5987, JP-B-38-7826, JP-B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926, and 3,582,346 and JP-B-41-11431; polyalkylene oxides as described in JP-B-37-16088, JP-B-42-25201, JP-B-41-11431, JP-B-42-23883 and U.S. Patents 3,128,183 and 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethyl-benzimidazole, indazole, hydroxyazaindolizine and adenine, etc.

It is preferred that the color developing solution used in the present invention contains a fluorescent brightening agent. As fluorescent brightening agents, 4,4'-diamino-2,2'-disulfostilbene type compounds are preferred. The amount of the fluorescent brightening agent added is from 0 to 5 g and preferably from 0.1 g to 4 g, per liter of the color developing solution.

Furthermore, the color developing solution according to the present invention may contain various surface active agents such as alkylsulfonic acids, arylphosphonic acids, aliphatic carboxylic acids, and aromatic carboxylic acids, etc., if desired.

The processing temperature of the color developing solution used in the present invention is usually from 20° C. to 50° C. and preferably from 30° C. to 45° C. The processing time is usually from 20 sec. to 5 min. and preferably from 30 sec. to 3 min. Further, the amount of replenishment for the color developing solution is preferably as small as feasible, and is usually from 100 ml to 1,500 ml, preferably from 100 ml to 800 ml, and more preferably from 100 ml to 400 ml, per square meter of the color light-sensitive material.

If required, the color developing bath may be divided into two or more baths, so that a color developing replenisher may be supplied from the first bath or the last bath to shorten the developing time or to reduce the amount of the replenisher.

The processing method according to the present invention can be used in a color reversal process. A suitable black-and-white developing solution used in this case includes a black-and-white first developing solution (used in reversal process of color photographic light-sensitive materials), or one that can be used in processing black-and-white photographic light-sensitive materials. Further, known various additives that are generally added to a black-and-white developing solution can be contained in the solution.

Representative additives include developing agents such as 1-phenyl-3-pyrazolidone, Metol ($HOC_6H_4NHCH_3.1/2H_2SO_4$) and hydroquinone; preservatives such as sulfites; accelerators comprising an alkali such as sodium hydroxide, sodium carbonate and potassium carbonate; inorganic or organic restrainers such as potassium bromide, 2-methylbenzimidazole and methylbenzothiazole; hard water softening agents such as polyphosphates; and development restrainers comprising trace amounts of iodides or mercapto compounds.

The processing method according to the present invention comprises processing steps including color development, bleaching, bleach-fixing, etc., as mentioned above. After the bleach-fixing step, although processing steps that include water washing and stabilizing are generally carried out, a simple processing method is also possible wherein after bleach-fixing, a stabilizing process is carried out without performing substantial water washing.

The washing water used in the water washing step can contain, if desired, known additives. For example, hard water softening agents such as inorganic phosphoric acid, amino-polycarboxylic acids and organic phosphoric acids, antibacterial and antifungal agents for preventing various bacteria and algae from proliferating (e.g., isothiazolone, organic chlorine type disinfectants and benzotriazole) and surface active agents for lowering drying load or for preventing uneven drying can be used. Compounds described, for example, in L. E. West, "Water Quality Criteria", *Phot. Sci. and Eng.*, Vol. 9, No. 6, pages 344 to 359 (1965) can also be used.

A suitable stabilizing solution used in the stabilizing step includes a processing solution for stabilizing dye images. For example, a solution having a pH of from 3 to 6 and a buffering ability and a solution containing an aldehyde (e.g., formalin) can be used. The stabilizing solution can contain, if desired, ammonium compounds, compounds containing metals such as Bi and Al, fluorescent brightening agents, chelating agents (e.g., 1-hydroxy-ethylidene-1,1-diphosphonic acid), antibacterial, antifungal agents, hardening agents, surface active agents, etc.

It is preferred to employ a multistage countercurrent system in the water washing step or stabilizing step. Two to four stages are preferably used. The amount of replenishment is from 1 to 50 times, preferably from 2 to 30 times and more preferably from 2 to 15 times the amount of processing solution carried over from the preceding bath per a unit area of the color light-sensitive material.

Water suitable for use in the water washing step or the stabilizing step includes city (tap) water, water that has been deionized, for example, by ion exchange resins to reduce Ca and Mg concentrations to 5 mg/liter or below, or water that has been sterilized, for example, by a halogen lamp or a bactericidal ultraviolet lamp.

When continuous processing is performed using an automatic developing machine, concentration of the processing solution tends to occur by evaporation in each step of the processing of color light-sensitive materials. This phenomenon particularly occurs in a case wherein a small amount of color light-sensitive materials is processed or wherein an open area of the processing solution is large. In order to compensate for such concentration of processing solution, it is preferred to replenish them with an appropriate amount of water or a correcting solution.

The present invention can be applied to various color photographic light-sensitive materials, and typical examples thereof include color negative films for general use or cinematography, color reversal films for slides or television, color papers, color positive films, color reversal papers, and direct positive color light-sensitive materials.

Suitable silver halide emulsions used in the color light-sensitive materials to be processed in accordance with the present invention can be prepared by using the method as described in *Research Disclosure*, Vol. 176, No. 17643, Item [I].

In the color light-sensitive materials processed in accordance with the present invention, any of silver bromide, silver iodobromide, silver iodochlorobromide, silver chlorobromide and silver chloride can be employed as silver halide. Silver halide containing at least 1 mol % of silver iodide is preferably employed.

The silver halide grains in the photographic emulsion may be so-called regular grains having a regular crystal form such as a cubic, octahedral or tetradecahedral structure, or may have an irregular crystal form such as a spherical crystal, a crystal defect such as a twin plane, or composite structure thereof.

The silver halide may be fine grains having a grain diameter of up to about 0.1 microns or coarse grains wherein the diameter of the projected area is up to about 10 microns, and a monodispersed emulsion having a narrow distribution or a polydispersed emulsion having a wide distribution can be used.

A typical monodispersed emulsion is one wherein the average grain diameter of the silver halide grains is greater than about 0.1 micron and at least about 95 wt % of the silver halide grains are within ±40% of the average grain diameter. In the present invention, an emulsion can be used wherein the average grain diameter is about 0.25 to 2 microns, and at least about 95% by weight or at least about 95% by number of the silver halide grains are within ±20% of the average particle diameter.

The crystal structure of the grains may be uniform, or the outer portion of the halogen composition may be different from the inner portion thereof, or may have a stratified structure. These types of emulsion grains are disclosed, for example, in British Patent 1,027,146, U.S. Pat. No. 3,505,068 and 4,44,877 and JP-A-60-143331.

Silver halide grains having different compositions joined upon epitaxial conjunction may also be employed.

When tabular grains are used in the silver halide photographic emulsions used in the present invention, improvement in sensitivity (including improvement in color sensitizing effect by sensitizing dyes), improvement in the relationship between sensitivity and graininess, improvement in sharpness, improvement in development proceeding, improvement in covering power and improvement in crossover, can be attained. The term "tabular silver halide grains" used herein refers to tabular silver halide grains whose diameter/thickness ratio is about 5 or higher, and, includes for example, tabular silver halide grains having a diameter/thickness ratio of more than 8 and tabular silver halide grains having a diameter/thickness ratio of from 5 to 8.

Preferably, the tabular grain halogen composition includes silver bromide, silver bromoiodide, silver bromochloride, silver bromochloroiodide, silver chloroiodide or silver chloride. For highly sensitive photographic materials, silver iodobromide is particularly preferably used. In the case of using silver iodobromide, the content of silver iodide is generally from not more than 40 mol %, preferably not more than 20 mol %, and more preferably not more than 15 mol %. For photographic materials used for printing, silver chloride and silver bromide are particularly preferred.

Tabular grains may comprise a uniform halogen composition or may be composed of two or more phases having different halogen compositions. For example, when silver iodobromide is used, the silver iodobromide tabular grains may have a structure with plural layers different in their iodide content. Preferred examples of the halogen composition of tabular silver halide grains and the distribution of the halogens in the grains are described, for example, in JP-A-58-113928 and JP-A-59-99433.

Preferred methods of using tabular silver halide grains according to the present invention are described in detail, for example, in *Research Disclosure*, No. 22534 (January, 1983) and *Research Disclosure*, No. 25330 (May, 1985), in which, for example, a method of using tabular silver halide grains based on the relationship between the thickness of the tabular silver halide grains and the optical properties thereof is disclosed.

To facilitate ripening of the formation of silver halide grains, it is useful to employ a silver halide solvent. For example, to facilitate ripening, it is known to allow an excess of halogen ions to be present in the reactor. Ripening agents other than halogen ions that can be used are ammonia, amine compounds, and thiocyanates such as alkali metal thiocyanates, particularly sodium thiocyanate, potassium thiocyanates and ammonium thiocyanate. The use of thiocyanate ripening agents is described in U.S. Pat. Nos. 2,222,264, 2,448,534 and 3,320,069. Commonly used thioether ripening agents as described in U.S. Pat. Nos. 3,271,157, 3,574,628 and 3,737,313 can also be used. Further, thione compounds as described in JP-A-53-82408 and JP-A-53-144319 can be employed.

Generally, the silver halide emulsions are chemically sensitized. Chemical sensitization is performed suitably in the presence of a gold compound and a thiocyanate compound or in the presence of a sulfur-containing compound as described in U.S. Pat. Nos. 3,857,711, 4,266,018 and 4,054,457, or in the presence of a sulfur-containing compound such as hypo (sodium thiosulfate), a thiourea type compound and a rhodanine type compound.

The silver halide photographic emulsion used in the present invention may be spectrally sensitized with a methine dye or other dyes. Sensitizing dyes particularly useful are cyanine dyes, merocyanine dyes and complex merocyanine dyes.

These sensitizing dyes may be used alone or in combination, and when they are used in combination, they are often used for the purpose of supersensitization. In addition to a sensitizing dye, the emulsion may contain a dye that does not have a spectral sensitizing effect itself, but exhibits a supersensitizing effect, or a material that does not absorb substantially visible light, but exhibits a supersensitizing effect.

Examples of these types of sensitizing dyes are described in *Research Disclosure*, Vol. 176, No. 17643, Item IV (December, 1978).

The spectral sensitization of the silver halide emulsion used in the present invention can be carried out during any stage of preparation of the emulsion. In particular, U.S. Pat. Nos. 4,183,756 and 4,225,666 disclose that it is advantageous to add a spectral sensitizing dye to an emulsion after the formation of stable nuclei for the formation of silver halide grains, since the adsorption of the photographic sensitizing dye onto the silver halide grains is enhanced.

For the purpose of increasing the sensitivity and the contrast or to facilitate development, the photographic emulsion layer of the photographic light-sensitive material according to the present invention may contain, for example, polyalkylene oxides or their derivatives such as their ethers, esters and amines, thioether compounds, thiomorpholines, quaternary ammonium salt compounds, urethane derivatives, urea derivatives, imidazole derivatives and 3-pyrazolidones.

The silver halide photographic emulsion used in the present invention may also contain various compounds for the purpose of preventing the photographic materials from fogging in the process of the preparation thereof or during the storage thereof, or during photographic processing, or for the purpose of stabilizing the photographic performance. Specifically, various compounds known as stabilizers or antifoggants can be added, for example, azoles such as benzothiazoliums, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (particularly, 1-phenyl-5-mercaptotetrazole); mercaptopyrimidines; mercaptotriazines; thioketo compounds such as oxazolinethione; azaindenes such as triazaindenes, tetraazaindenes (particularly, 4-hydroxy substituted (1,3,3a,7)tetraazaindenes) and pentaazaindenes; benzenethiosulfonic acid, benzenesulfinic acid; and benzenesulfonic acid amide.

In the photographic material to be processed in accordance with the present invention, various types of couplers can be used, and specific examples thereof are described in the patents cited in *Research Disclosure*, No. 17643, Items VII-C to VII-G. Important dye forming couplers include couplers that give rise to the three primary colors (that is, yellow, magenta and cyan) of the subtractive color process by color development, and suitable examples of diffusion resistant 4-equivalent or 2-equivalent couplers include those described in the patents cited in *Research Disclosure*, No. 17643, Items VII-C and D. Also, the couplers described below can be preferably used.

Typical yellow couplers useful in the present invention include oil protected acylacetamide type couplers. Specific examples thereof are described, for example, in U.S. Pat. Nos. 2,407,210, 2,875,057 and 3,265,506. In the present invention, 2-equivalent yellow couplers are preferably employed and typical examples thereof include yellow couplers of oxygen atom releasing type as described, for example, in U.S. Pat. Nos. 3,408,194, 3,447,928, 3,933,501 and 4,022,620, and yellow couplers of nitrogen atom releasing type as described, for example, in JP-B-55-10739, U.S. Pat. Nos. 4,401,752 and 4,326,024, *Research Disclosure*, No. 18053 (April, 1979), British Patent 1,425,020 and West German Patent Application (OLS) Nos. 2,219,917, 2,261,361, 2,329,587 and 2,433,812. α-Pivaloylacetanilide type couplers are characterized by fastness, particularly light fastness, of the dyes formed, and α-benzoylacetanilide type couplers are characterized by providing a high color density.

Magenta couplers useful in the present invention include oil protected indazolone type couplers, cyanoacetyl type couplers, and preferably 5-pyrazolone type couplers and pyrazoloazole type couplers such as pyrazolotriazoles. Of 5-pyrazolone type couplers, those substituted with an arylamino group or an acylamino group at the 3-position thereof are preferred in view of hue and color density of images formed. Typical examples thereof are described, for example, in U.S. Pat. Nos. 2,311,082, 2,343,703, 2,600,788, 2,908,573, 3,062,653, 3,152,896 and 3,936,015. 2-Equivalent 5-pyrazolone type couplers are preferably used. Particularly, nitrogen atom releasing groups as described in U.S. Pat. No. 4,310,619 and arylthio groups as described in U.S. Pat. No. 4,351,897 and preferred as releasing groups. Further, 5-pyrazalone type couplers having a ballast group described in European Patent 73,636 are advantageous because they provide a high color density.

Examples of pyrazoloazole type couplers include pyrazolobenzimidazoles as described in U.S. Pat. No. 3,369,879, and preferably pyrazolo[5,1-c][1,2,4]-triazoles as described in U.S. Pat. No. 3,725,067, pyrazolotetrazoles as described in *Research Disclosure*, No. 24220 (June, 1984) and pyrazolopyrazoles as described in Research Disclosure, No. 24230 (June, 1984). Imidazo[1,2-b]pyrazoles as described in European Patent 119,741 are preferred and pyrazolo[1,5-b][1,2,4]-triazoles as described in European Patent 119,860 are particularly preferred, in view of less yellow subsidiary absorption and light fastness of dyes formed.

As cyan couplers useful in the present invention, oil protected naphthol type and phenol type couplers are exemplified. Typical examples thereof include naphthol type couplers as described in U.S. Pat. No. 2,474,293 and preferably oxygen atom releasing type 2-equivalent naphthol type couplers as described, for example, in U.S. Pat. Nos. 4,052,212, 4,146,396, 4,228,233 and 4,296,200, and phenol type couplers as described, for example, in U.S. Pat. Nos. 2,369,929, 2,801,171, 2,772,162 and 2,895,826.

Cyan couplers fast to humidity and temperature are preferably used in the present invention. Typical examples thereof include phenol type cyan couplers having an alkyl group having two or more carbon atoms at the meta-position of the phenol nucleus as described in U.S. Pat. No. 3,772,002, 2,5-diacylamino-substituted phenol type couplers as described, for example, in U.S. Pat. Nos. 2,772,162, 3,758,308, 4,126,396, 4,334,011 and 4,327,173, West German Patent Application (OLS) No. 3,329,729 and JP-A-59-166956, and phenol type couplers having a phenylureido group at the 2-position thereof and an acylamino group at the 5-position thereof as described, for example, in U.S. Pat. Nos. 3,446,622, 4,333,999, 4,451,559 and 4,427,767.

Couplers capable of forming appropriately diffusible dyes can be used in combination in order to improve graininess. Specific examples of such couplers include the magenta couplers as described, for example, in U.S. Pat. No. 4,366,237 and the low, magenta and cyan couplers as described, for example, in European Patent 96,570.

Dye forming couplers and the special couplers as described above may be in the form of polymers including dimers or more. Typical examples of dye forming couplers that are polymerized are described, for example, in U.S. Pat. No. 3,451,820. Specific examples of polymerized magenta couplers are described, for example, in U.S. Pat. No. 4,367,282.

Couplers capable of releasing a photographically useful group upon the coupling reaction can also preferably be used in the present invention. Useful DIR couplers which release a development inhibitor include the couplers described in the patents cited in *Research Disclosure*, No. 17643, Item VII-F.

In the color light-sensitive materials according to the present invention, couplers can be used which as capable of releasing imagewise a nucleating agent, a development accelerator or a precursor thereof when developed. Specific examples of such compounds are described, for example, in British Patents 2,097,140 and 2,131,188. Also, for example, DIR redox compound-releasing couplers as described, for example, in JP-A-60-185950 and couplers which can release a dye that will restore color after being released as described, for example, in European Patent 173,302A, can be used.

Couplers which can be used in the present invention are incorporated into the color light-sensitive material by any one of various known dispersion methods. Examples of organic solvents having a high boiling point used in the oil-in-water droplet dispersion method are described, for example, in U.S. Pat. No. 2,322,027. Further, the latex dispersion method, the effects thereof, and specific examples of latexes for impregnation are described, for example, in U.S. Pat. No. 4,199,363 and West German Patent Application (OLS) Nos. 2,541,274 and 2,541,230.

The color light-sensitive materials used in the present invention may contain, as color fog preventing agents or color mixing preventing agents, hydroquinone derivatives, aminophenol derivatives, amines, gallic acid derivatives, catechol derivatives, ascorbic acid derivatives, non-color-forming couplers and sulfonamidophenol derivatives.

The color light-sensitive materials used in the present invention can also contain known color fading preventing agents. Typical examples of known color fading preventing agents include hindered phenols such as hydroquinones, 6-hydroxycoumarones 5-hydroxycoumarans, p-alkoxyphenols, spirochromans or bisphenols; gallic acid derivatives, methylenedioxybenzenes, aminophenols, hindered amines and also ether or ester derivatives thereof wherein the phenolic hydroxyl group of these compounds is silylated or alkylated.

In the color light-sensitive materials used in the present invention, an ultraviolet light absorbing agent can be added into a hydrophilic colloid layer thereof. Typical examples of ultraviolet light absorbing agents are described, for example, in *Research Disclosure*, No. 24239 (June, 1984).

The color light-sensitive materials used in the present invention may contain one or more surface active agents as coating assistants, as antistatic agents, or for the purposes of improving the slipping characteristics, the emulsification/dispersion ability and the photographic characteristics (e.g., acceleration of development, increase in contract and sensitization), for the purpose of preventing adhesion and for other purposes.

Examples of useful surface active agents include nonionic surface active agents, such as saponin (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or alkylamides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugars, etc.; anionic surface active agents containing an acid group (e.g., carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric suface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

The color light-sensitive materials used in the present invention may contain water-soluble dyes in a hydrophilic colloid layer as filter dyes or for the purpose of preventing irradiation or halation, or for other purposes. Preferred examples of such dyes include oxonol dyes, hemioxonol dyes, styryl dyes, merocyanine dyes, anthraquinone dyes and azo dyes, and cyanine dyes, azomethine dyes, triarylmethane dyes and phthalocyanine dyes can also be used. Oil-soluble dyes can be emulsified by the oil-in-water-droplet dispersion method to be added to the hydrophilic colloid layer.

In the color light-sensitive materials used in the present invention, in order to introduce oleophilic compounds (such as photographic couplers) into a hydrophilic organic colloid layer, various methods can be used, such as the oil-in-water-droplet dispersion method, the latex dispersion method, the solid dispersion method and the alkali dispersion method. A preferred method can be suitably selected depending on the chemical structure and the physicochemical properties of the compound to be incorporated therein.

EXAMPLE

The present invention will now be explained in greater detail with reference to the following examples, but the present invention should not be construed as being limited thereto.

In the following examples, the bleach accelerating compounds of formula (I) according to the present invention will be indicated using the numbers which are affixed to the specific compounds set forth hereinbefore. Comparative compounds used in the following examples are shown below.

Bleach accelerating agent (A):

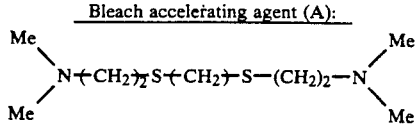

(Compound described in JP-B-60-24936)

Bleach accelerating agent (B):

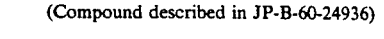

(Compound described in JP-B-60-24936)

Bleach accelerating agent (C):

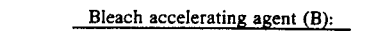

(Compound described in JP-B-60-24936)

Bleach accelerating agent (D):

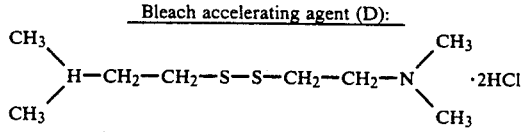

(Compound described in JP-A-53-95630)

Bleach accelerating agent (E):

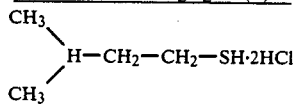

(Compound described in U.S. Pat. No. 3,893,858)

Bleach accelerating agent (F):

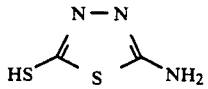

(Compound described in British Patent 1,138,842)

Bleach accelerating agent (G):

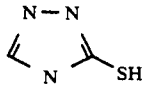

(Compound described in British Patent 1,138,842)

EXAMPLE 1

On a cellulose triacetate film support having a subbing layer was coated layers having the composition set forth below to prepare a multilayer color light-sensitive material which was designated Light-sensitive material A.

Composition of the light-sensitive material

With respect to the compositions of the layers, coated amounts of silver halide and colloidal silver are shown by g/m$^2$ units of silver, the coated amounts of couplers, additives and gelatin are shown by g/m$^2$ units, and the coated amounts of sensitizing dyes are shown by mol number per mol of silver halide being present in the same layer.

| First Layer: Antihalation Layer | |
|---|---|
| Black colloidal silver | 0.2 |
| Gelatin | 1.3 |
| ExM-9 | 0.06 |

-continued

| | |
|---|---|
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer: Intelayer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: Low-Sensitive Red-Sensitive Emulsion Layer | |
| Silver iodobromide emulsion (AgI: 4 mol %, uniform AgI type, diameter corresponding to sphere: 0.5 μm, coefficient of variation of diameter corresponding to sphere: 20%, tabular grain, diameter/ thickness ratio: 3.0) | 1.2 g (as silver) |
| Silver iodobromide emulsion (AgI: 3 mol %, uniform AgI type, diameter corresponding to sphere: 0.3 μm, coefficient of variation of diameter corresponding to sphere: 15%, spherical grain, diameter/ thickness ratio: 1.0) | 0.6 (as silver) |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |
| Fourth Layer: High-Sensitive Red-sensitive Emulsion Layer | |
| Silver iodobromide emulsion (AgI: 6 mol %, internal high AgI type, with core/shell ratio of 1/1, diameter corresponding to sphere: 0.7 μm, coefficient of variation of diameter corresponding to sphere: 15%, tabular grain, diameter/ thickness ratio: 5.0) | 0.7 (as silver) |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Intelayer | |
| Gelatin | 0.5 |
| Cpd-1 | 0.1 |
| Solv-1 | 0.05 |
| Sixth Layer: Low-Sensitive Green-Sensitive Emulsion Layer | |
| Silver iodobromide emulsion (AgI: 4 mol %, surface high AgI type, with core/shell ratio of 1/1, diameter corresponding to sphere: 0.5 μm, coefficient of variation of diameter corresponding to sphere: 15%, tabular grain, diameter/ thickness ratio: 4.0) | 0.35 (as silver) |
| Silver iodobromide emulsion (AgI: 3 mol %, uniform AgI type, diameter corresponding to sphere: 0.3 μm, coefficient of variation of diameter corresponding to sphere: 25%, spherical grain, diameter/ thickness ratio: 1.0) | 0.20 (as silver) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |

-continued

| | |
|---|---|
| Solv-1 | 0.3 |
| Solv-4 | 0.05 |
| Seventh Layer: High-Sensitive Green-Sensitive Emulsion Layer | |
| Silver iodobromide emulsion (AgI: 4 mol %, internal high AgI type, with core/shell ratio of 1/3, diameter corresponding to sphere: 0.7 μm, coefficient of variation of diameter corresponding to sphere: 20%, tabular grain, diameter/ thickness ratio: 5.0) | 0.8 (as silver) |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer: Interlayer | |
| Gelatin | 0.5 |
| Cpd-1 | 0.05 |
| Solv-1 | 0.02 |
| Ninth Layer: Donor Layer of Interlayer Effect to Red-Sensitive Layer | |
| Silver iodobromide emulsion (AgI: 2 mol %, internal high AgI type, with core/shell ratio of 2/1, diameter corresponding to sphere: 1.0 μm, coefficient of variation of diameter corresponding to sphere: 15%, tabular grain, diameter/ thickness ratio: 6.0) | 0.35 (as silver) |
| Silver iodobromide emulsion (AgI: 2 mol %, internal high AgI type, diameter corresponding to sphere: 0.4 μm, coefficient of variation of diameter corresponding to sphere: 20%, tabular grain, diameter/ thickness ratio: 6.0) | 0.20 (as silver) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow Colloidal Silver | 0.05 |
| Gelatin | 0.5 |
| Cpd-2 | 0.13 |
| Solv-1 | 0.13 |
| Cpd-1 | 0.10 |
| Eleventh Layer: Low-Sensitive Blue-Sensitive Emulsion Layer | |
| Silver iodobromide emulsion (AgI: 4.5 mol %, uniform high AgI type, diameter corresponding to sphere: 0.7 μm, coefficient of variation of diameter corresponding to sphere: 15%, tabular grain, diameter/ thickness ratio: 7.0) | 0.3 (as silver) |
| Silver iodobromide emulsion (AgI: 3 mol %, uniform AgI type, diameter corresponding to sphere: 0.3 μm, coefficient of variation of diameter corresponding to sphere: 25%, tabular grain, diameter/ thickness ratio: 7.0) | 0.15 (as silver) |
| Gelatin | 0.5 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Twelfth Layer: High-Sensitive Blue-Sensitive Emulsion | |

-continued

| Layer | |
|---|---|
| Silver iodobromide emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine grain silver iodobromide emulsion (AgI: 2 mol %, uniform AgI type, diameter corresponding to sphere: 0.07 μm) | 0.5 (as silver) |
| Gelatin | 0.45 |
| Polymethyl methacrylate particle (diameter: 1.5 μm) | 0.2 |
| H-1 | 0.4 |
| Cpd-5 | 0.5 |
| Cpd-6 | 0.5 |

Each layer described above further contained a stabilizer for emulsions (Cpd-3: 0.04 g/m$^2$) and a surface active agent (Cpd-4: 0.02 g/m$^2$) as a coating aid in addition to the above described compounds.

The compounds used for the preparation of Sample A are illustrated below.

UV-1

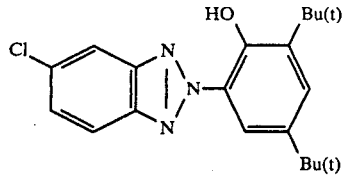

UV-2

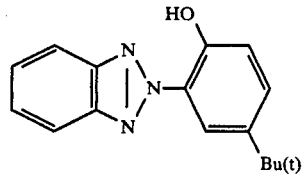

UV-3

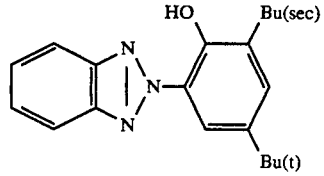

UV-4

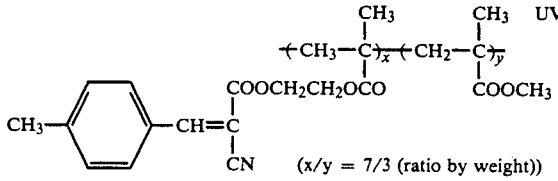

(x/y = 7/3 (ratio by weight))

UV-5

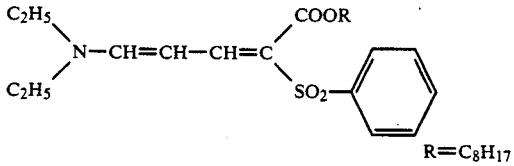

Solv-1: Tricresyl phosphate
Solv-2: Dibutyl phthalate

Solv-3

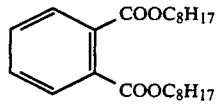

Solv-4

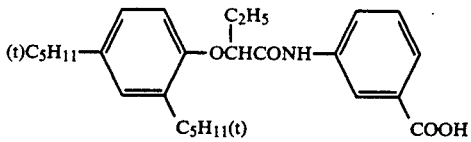

Cpd-1

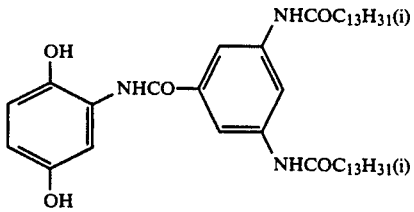

Cpd-2

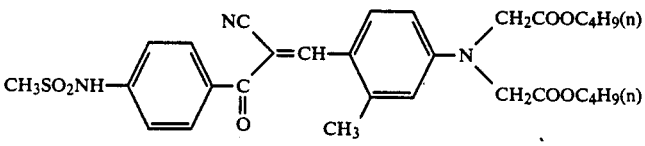

-continued
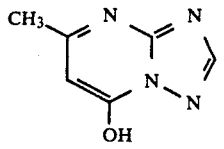
Cpd-3
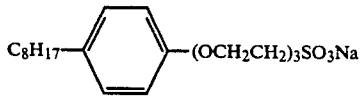
Cpd-4
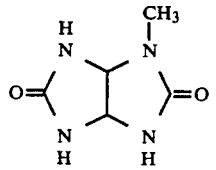
Cpd-5
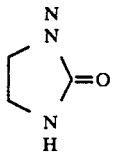
Cpd-6
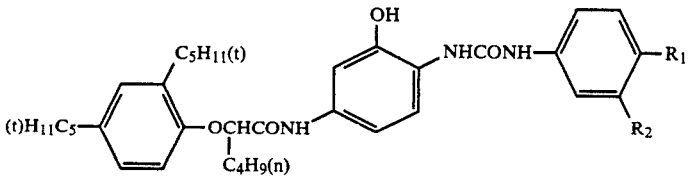
$R_1$ = CN, $R_2$ = H
ExC-1
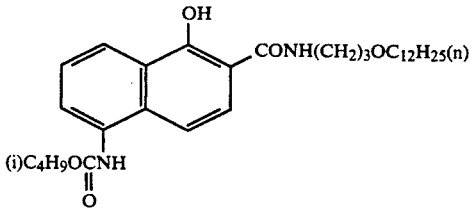
ExC-2
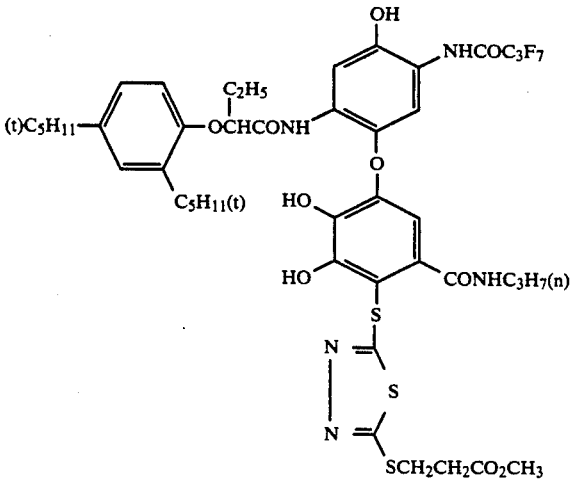
ExC-3

-continued
ExC-4
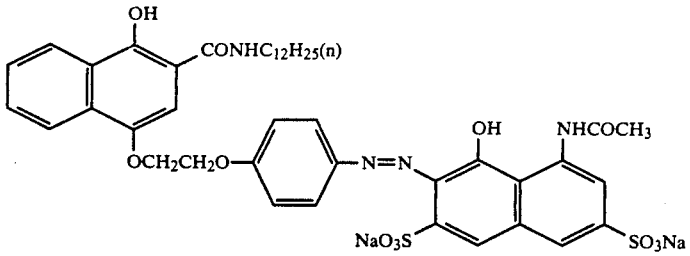
ExC-5
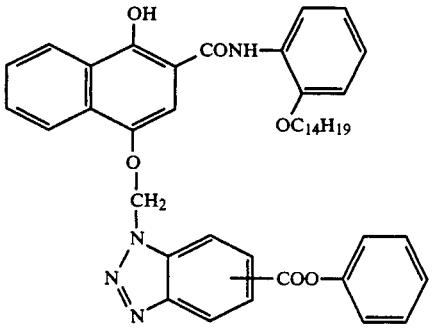
ExC-6
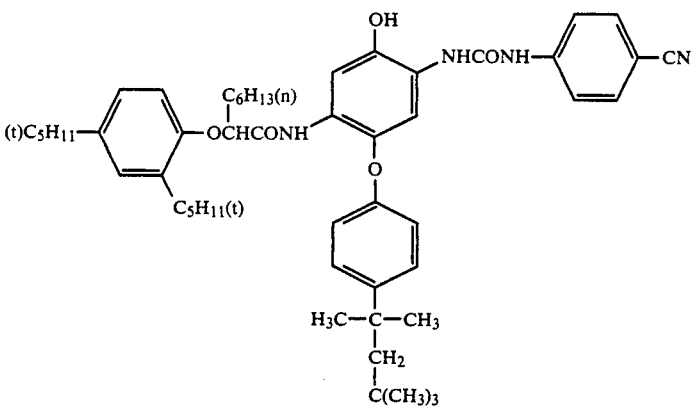
ExC-7
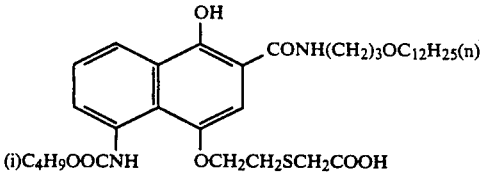
ExM-8
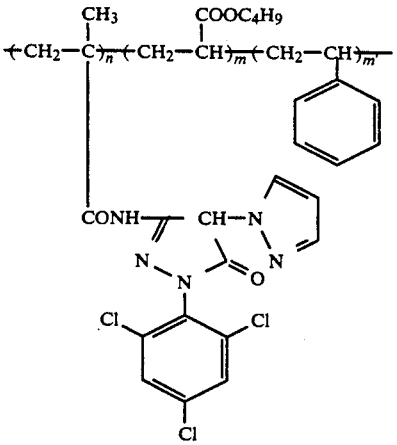
n = 50
m = 25
m' = 25

-continued
mol. wt. about 20,000
ExM-9
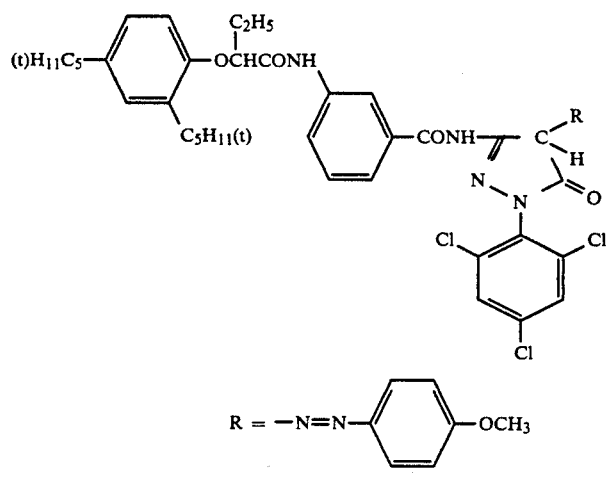
ExM-10
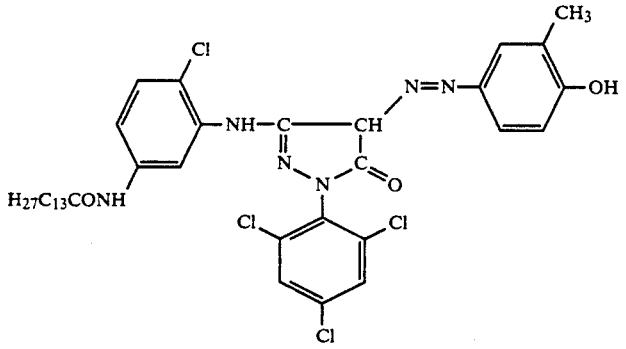
ExY-11
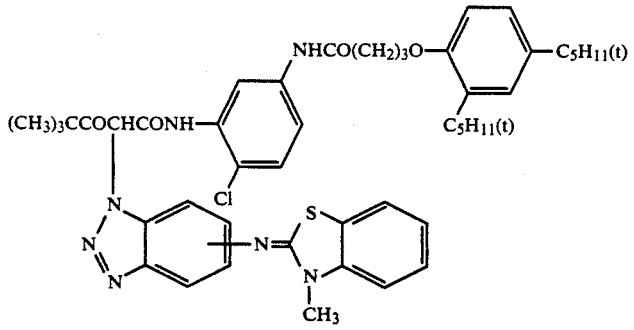
ExM-12
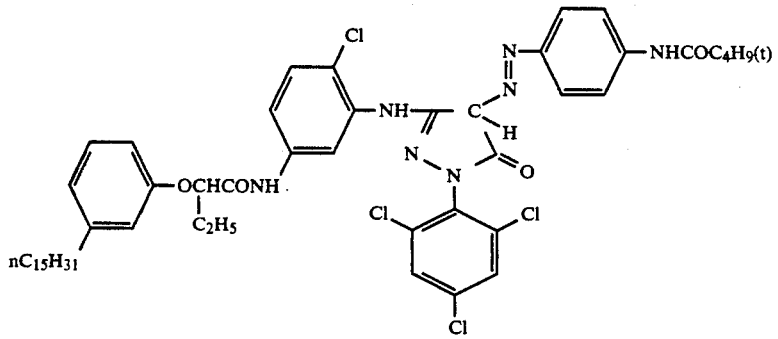

-continued
ExY-13
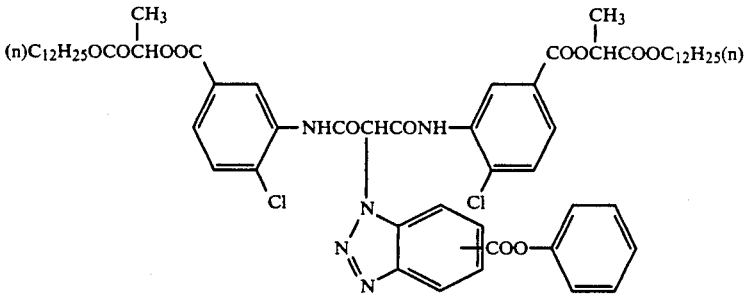
ExM-14
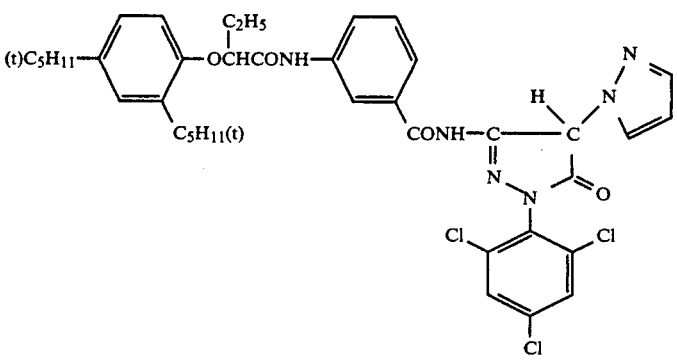
ExY-15
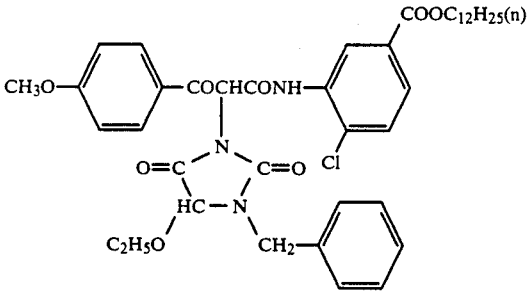
ExC-16
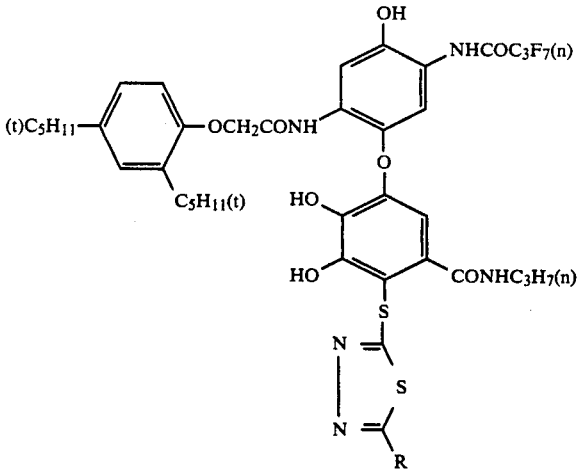
R = $SCH_2CH_2COOCH_3$
ExS-1
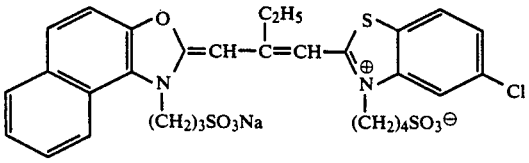

-continued

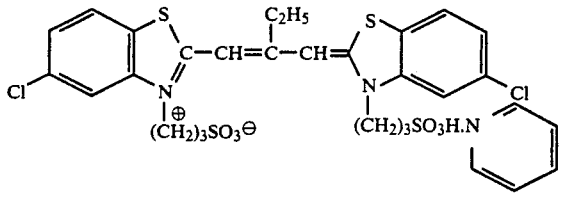

ExS-2

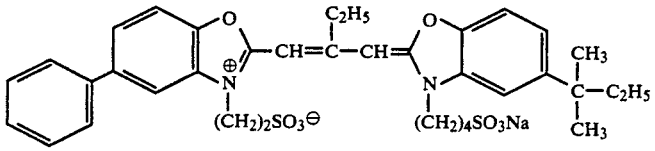

ExS-4

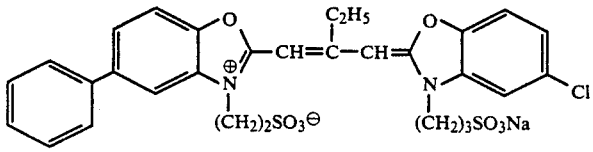

ExS-5

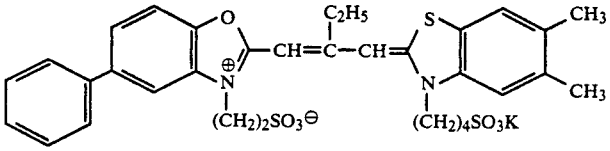

ExS-6

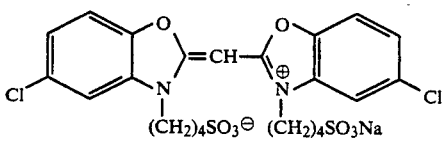

H-1

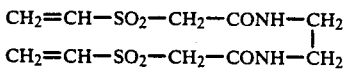

ExF-1

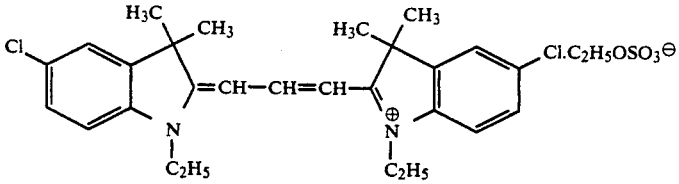

The light-sensitive material thus-prepared was exposed to light in an exposure amount of 10 CMS using a light source of 4800° K. (color temperature) and then subjected to development processing according to the following processing steps. In the bleaching step, bleaching solutions containing a bleach accelerating agent as shown in Table 1 below and a bleaching solution which did not contain a bleach accelerating agent were employed, respectively.

| Processing Step | Processing Time | Processing Temperature |
|---|---|---|
| Color Development | 2 min. 30 sec. | 40° C. |
| Bleaching | 1 min. 30 sec. | 40° C. |
| Fixing | 2 min. 30 sec. | 40° C. |
| Washing with Water | 1 min. 30 sec. | 40° C. |
| Stabilizing | 30 sec. | 40° C. |
| Drying | 1 min. | — |

The composition of each processing solution used is illustrated below.

Color Developing Solution

| | |
|---|---|
| Diethylenetriaminepenta-acetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxy-ethylamino)-2-methyl-aniline Sulfate | 5.0 g |
| Water to make | 1.0 l |
| pH | 10.20 |

Bleaching Solution

| | |
|---|---|
| Ammonium Iron (III) Ethylenediaminetetra-acetate Dihydrate | 120 g |
| Disodium Ethylenediamine-tetraacetate | 10.0 g |
| Aqueous Ammonia | 7 ml |
| Ammonium Nitrate | 10.0 g |
| Ammonium Bromide | 100.0 g |
| Bleach Accelerating Agent | (shown in Table 1 below) |
| Water to make | 1.0 l |
| pH | 6.0 |

Fixing Solution

| | |
|---|---|
| Disodium Ethylenediamine-tetraacetate | 2.0 g |
| Sodium Sulfite | 4.0 g |
| Ammonium Thiosulfate (700 g/l aq. soln.) | 175.0 ml |
| Sodium Bisulfite | 4.6 g |
| Water to make | 1.0 l |
| pH | 6.6 |

Stabilizing Solution

| | |
|---|---|
| Formalin (37 wt %) | 0.2 ml |
| Polyoxyethylene-p-monononylphenylether (average degree of polymerization: 10) | 0.3 g |
| Water to make | 1.0 l |

To the bleaching solution were added the compounds shown in Table 1 respectively and their bleach accelerating abilities were compared based on the amount of remaining silver. The amount of remaining silver was determined by X-ray fluorometric analysis. Further, the presenced stains on the photographic material after processing was visually observed. The results thus-obtained are shown in Table 1 below.

TABLE 1

| Run No. | Bleach* Accelerating Agent | Amount of Remaining Silver ($\mu g/cm^2$) | Stains After Processing | Remark |
|---|---|---|---|---|
| 1 | — | 21.3 | not observed | Comparison |
| 2 | (A) | 6.2 | observed | " |
| 3 | (B) | 7.3 | observed | " |
| 4 | (C) | 8.5 | slightly observed | " |
| 5 | (1) | 5.2 | not observed | Present Invention |
| 6 | (2) | 5.0 | not observed | Present Invention |
| 7 | (5) | 4.9 | not observed | Present Invention |
| 8 | (7) | 4.7 | not observed | Present Invention |
| 9 | (11) | 4.5 | not observed | Present Invention |
| 10 | (12) | 4.2 | not observed | Present Invention |
| 11 | (16) | 4.8 | not observed | Present Invention |
| 12 | (27) | 3.2 | not observed | Present Invention |
| 13 | (29) | 3.4 | not observed | Present Invention |
| 14 | (31) | 3.5 | not observed | Present Invention |
| 15 | (35) | 3.6 | not observed | Present Invention |
| 16 | (37) | 3.8 | not observed | Present Invention |
| 17 | (41) | 3.7 | not observed | Present Invention |
| 18 | (44) | 3.3 | not observed | Present Invention |

*Amount added: $5 \times 10^{-3}$ mol per liter of the bleaching solution.

As is apparent from the results shown in Table 1, a rapid desilvering process is realized using the compounds according to the present invention as the bleach accelerating agent.

EXAMPLE 2

The same procedure as described in Example 1 was repeated except that the bleaching solution was substituted with the one set forth below, and similar results to those in Example 1 were obtained.

Bleaching Solution

| | |
|---|---|
| Ammonium Iron (III) 1,3-diaminopropane-tetraacetate | 30 g |
| Ammonium Iron (III) Ethylenediaminetetra-acetate Dihydrate | 90 g |
| Disodium Ethylenediaminetetraacetate | 10.0 g |
| Aqueous Ammonia (27% weight/weight) | 7.0 ml |
| Ammonium Nitrate | 10.0 g |
| Ammonium Bromide | 100.0 g |
| Bleach Accelerating Agent | (shown in Table 1 above) |
| Water to make | 1.0 l |
| pH | 5.5 |

EXAMPLE 3

Light-sensitive material A as prepared in Example 1 was exposed to light in the same manner as described in Example 1 and then subjected to development processing according to the following processing steps. In the bleaching step, a bleaching solution containing a bleach accelerating agent as shown in Table 2 below and a bleaching solution which did not contain a bleach accelerating agent were employed, respectively.

| Processing Step | Processing Time | Processing Temperature |
|---|---|---|
| Color Development | 2 min. 30 sec. | 40° C. |
| Bleach-Fixing | 2 min. | 40° C. |
| Washing with Water | 1 min. 30 sec. | 40° C. |
| Drying | 1 min. | 60° C. |

The composition of each processing solution used is illustrated below.

Color Developing Solution

Same composition as described in Example 1.

Bleach-Fixing Solution

| | |
|---|---|
| Ammonium Iron (III) Ethylenediaminetetra-acetate Dihydrate | 60.0 g |
| Disodium Ethylenediaminetetraacetate | 9.0 g |
| Sodium Sulfite | 12.0 g |

-continued

| | |
|---|---|
| Ammonium Thiosulfate (700 g/l aq. soln.) | 240 ml |
| Bleach Accelerating Agent | (shown in Table 2 above) |
| Water to make | 1.0 l |
| pH | 6.5 |

Washing Water

| | |
|---|---|
| Polyoxyethylene-p-monononylphenylether (average degree of polymerization: 10) | 0.3 g |
| Distilled Water to make | 1.0 l |

After the processing, the amount of remaining silver was determined by X-ray fluorometric analysis. Further, the presence of stains on the photographic material after processing was visually observed. The results thus-obtained are shown in Table 2 below.

TABLE 2

| Run No. | Bleach* Accelerating Agent | Amount of Remaining Silver ($\mu m/cm^2$) | Stains After Processing | Remark |
|---|---|---|---|---|
| 19 | — | 22.4 | not observed | Comparison |
| 20 | (A) | 10.3 | observed | " |
| 21 | (B) | 11.2 | observed | " |
| 22 | (C) | 13.3 | slightly observed | " |
| 23 | (1) | 4.8 | not observed | Present Invention |
| 24 | (2) | 4.5 | not observed | Present Invention |
| 25 | (5) | 4.6 | not observed | Present Invention |
| 26 | (7) | 4.5 | not observed | Present Invention |
| 27 | (11) | 3.9 | not observed | Present Invention |
| 28 | (12) | 3.8 | not observed | Present Invention |
| 29 | (16) | 4.2 | not observed | Present Invention |
| 30 | (27) | 2.8 | not observed | Present Invention |
| 31 | (29) | 2.5 | not observed | Present Invention |
| 32 | (31) | 2.7 | not observed | Present Invention |
| 33 | (35) | 2.9 | not observed | Present Invention |
| 34 | (37) | 3.0 | not observed | Present Invention |
| 35 | (41) | 2.9 | not observed | Present Invention |
| 36 | (44) | 2.8 | not observed | Present Invention |

*Amount added: $5 \times 10^{-3}$ mol per liter of the bleach fixing solution.

As is apparent from the results shown in Table 2, desilveration in the bleach-fixing step is remarkably accelerated using the compound according to the present invention.

Further, it can be seen from the comparison of the results shown in Table 2 with those shown in Table 1 of Example 1 that the bleach accelerating effect (the decrease in the amount of remaining silver compared with the case wherein the bleach accelerating agent was not added) of the compounds according to the present invention are significantly attained when they are used in a bleach-fixing solution in comparison with the cases wherein they are used in a bleaching solution.

EXAMPLE 4

The same procedure as described in Example 3 was repeated except that the bleach-fixing solution was changed to one set forth below, and similar results to those in Example 3 were obtained.

Bleach-Fixing Solution

| | |
|---|---|
| Ammonium Iron (III) Diethylenediamine-pentaacetate | 60.0 g |
| Diethylenetriaminepentaacetic Acid | 5.0 g |
| Sodium Sulfite | 12.0 g |
| Ammonium Thiosulfate (700 g/l aq. soln.) | 240 ml |
| Bleach Accelerating Agent | (shown in Table 2 above) |
| Water to make | 1.0 l |
| pH | 7.5 |

The pH was adjusted with aqueous ammonia (27% weight/weight).

EXAMPLE 5

The same procedure as described in Example 3 was repeated except that the bleach accelerating agent and the amount thereof used in the bleach-fixing solution were changed as shown in Table 3 below. The amount of remaining silver thus-obtained are shown in Table 3 below.

TABLE 3

| Run No. | Bleach Accelerating Agent | Amount of Bleach Accelerating Agent Added (mol/l) | Solubility* of Bleach Accelerating Agent | Amount of Remaining Silver |
|---|---|---|---|---|
| 19 | — | — | — | 22.4 |
| 37 | (12) | $5 \times 10^{-6}$ | A | 21.0 |
| 38 | " | $1.5 \times 10^{-5}$ | A | 17.0 |
| 39 | " | $5 \times 10^{-5}$ | A | 15.0 |
| 40 | " | $1.5 \times 10^{-4}$ | A | 12.8 |
| 41 | " | $5 \times 10^{-4}$ | A | 9.8 |
| 42 | " | $1.5 \times 10^{-3}$ | A | 5.5 |
| 43 | " | $5 \times 10^{-3}$ | A | 3.8 |
| 44 | " | $1.5 \times 10^{-2}$ | A | 5.2 |
| 45 | " | $5 \times 10^{-2}$ | B | 9.8 |
| 46 | " | $1.5 \times 10^{-1}$ | C | 15.5 |
| 47 | (31) | $5 \times 10^{-6}$ | A | 20.0 |
| 48 | " | $1.5 \times 10^{-5}$ | A | 16.0 |
| 49 | " | $5 \times 10^{-5}$ | A | 14.8 |
| 50 | " | $1.5 \times 10^{-4}$ | A | 14.0 |
| 51 | " | $5 \times 10^{-4}$ | A | 10.5 |
| 52 | " | $1.5 \times 10^{-3}$ | A | 4.5 |
| 53 | " | $5 \times 10^{-3}$ | A | 2.7 |
| 54 | " | $1.5 \times 10^{-2}$ | B | 2.5 |
| 55 | " | $5 \times 10^{-2}$ | C | 5.0 |
| 56 | " | $1.5 \times 10^{-1}$ | | 9.8 |

*A: Completely Soluble in the bleach-fixing solution (at 40° C.)
B: Small amount of insoluble compound was observed
C: Large amount of insoluble compound was observed From the results shown in Table 3 above it is apparent that the compounds according to the present invention exhibit the smallest amounts of remaining silver when they are added to the bleach-fixing solution in the amount from $1.5 \times 10^{-3}$ to $1.5 \times 10^{-2}$ mol per liter of the solution, and the desilvering effect decreases when they are employed in amounts larger or smaller amount than the above range.

EXAMPLE 6

On a cellulose triacetate film support having a subbing layer was coated layers having the composition set forth below to prepare a multilayer color light-sensitive material, which was designated light-sensitive material B.

Composition of the light-sensitive material

With respect to the compositions of the layers, coated amounts are shown in units of $g/m^2$, coated amounts of silver halide and colloidal silver are shown by a silver coated amount in units of $g/m^2$, those of sensitizing dyes are shown as a molar amount per mol of silver halide being present in the same layer.

| | |
|---|---|
| First Layer: Antihalation Layer | |
| Black colloidal silver | 0.18 (as silver) |
| Gelatin | 0.40 |
| Second Layer: Interlayer | |
| 2,5-Di-tert-pentadecylhydro-quinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer: First Red-Sensitive Emulsion Layer | |
| Monodispersed Silver Iodobromide Emulsion (silver iodide: 6 mol %, average particle diameter: 0.6 μm, coefficient of variation on particle diameter: 0.15) | 0.55 (as silver) |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| Fourth Layer: Second Red-Sensitive Emulsion Layer | |
| Tabular Silver Iodobromide Emulsion (silver iodide: 10 mol %, average particle diameter: 0.7 μm, average aspect ratio: 5.5, average thickness: 0.2 μm) | 1.00 (as silver) |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| Fifth Layer: Third Red-Sensitive Emulsion Layer | |
| Silver Iodobromide Emulsion (silver iodide: 16 mol %, average particle diameter: 1.1 μm) | 1.60 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| Sixth Layer: Interlayer | |
| EX-5 | 0.040 |
| HBS-1 | 0.020 |
| EX-12 | 0.004 |
| Gelatin | 0.80 |
| Seventh Layer: First Green-Sensitive Emulsion Layer | |
| Tabular Silver Iodobromide Emulsion (silver iodide: 6 mol %, average particle diameter: 0.6 μm, average aspect ratio: 6.0, average thickness: 0.15 μm) | 0.40 (as silver) |
| Sensitizing Dye V | $3.0 \times 10^{-5}$ |

-continued

| | |
|---|---|
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 1.75 |
| Eighth Layer: Second Green-Sensitive Emulsion Layer | |
| Monodispersed Silver Iodobromide Emulsion (silver iodide: 9 mol %, average particle diameter: 0.7 μm, coefficient of variation on particle diameter: 0.18) | 0.80 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |
| Ninth Layer: Third Green-Sensitive Emulsion Layer | |
| Silver Iodobromide Emulsion (silver iodide: 12 mol %, average particle diameter: 1.0 μm) | 1.2 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Tenth Layer: Yellow Filter Layer | |
| Yellow Colloidal Silver | 0.05 (as silver) |
| EX-5 | 0.08 |
| HBS-3 | 0.03 |
| Gelatin | 0.95 |
| Eleventh Layer: First Blue-Sensitive Emulsion Layer | |
| Tabular Silver Iodobromide Emulsion (silver iodide: 6 mol %, average particle diameter: 0.6 μm, average aspect ratio: 5.7, average thickness: 0.15 μm) | 0.24 (as silver) |
| Sensitizing Dye VIII | $3.5 \times 10^{-4}$ |
| EX-9 | 0.85 |
| EX-8 | 0.12 |
| HBS-1 | 0.28 |
| Gelatin | 1.28 |
| Twelfth Layer: Second Blue-Sensitive Emulsion Layer | |
| Monodispersed Silver Iodobromide Emulsion (silver iodide: 10 mol %, average particle diameter: 0.8 μm, coefficient of variation on particle diameter: 0.16) | 0.45 (as silver) |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Thirteenth Layer: Third Blue-Sensitive Emulsion Layer | |
| Silver Iodobromide Emulsion (silver iodide: 14 mol %, average particle diameter: 1.3 μm) | 0.77 (as silver) |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Silver Iodobromide Emulsion (silver iodide: 1 mol %, average particle diameter: 0.07 μm) | 0.5 (as silver) |
| U-4 | 0.11 |
| U-5 | 0.17 |
| HBS-1 | 0.90 |

-continued

| | |
|---|---|
| Gelatin | 1.00 |
| Fifteenth Layer: Second Protective Layer | |
| Polymethyl methacrylate particle (diameter: about 1.5 μm) | 0.54 |
| S-1 | 0.15 |
| S-2 | 0.05 |
| Gelatin | 0.72 |

Gelatin Hardener H-1 and a surface active agent were added to each of the layers in addition to the above described components.

The compounds employed for the preparation of light-sensitive material B are shown below.

U-1: Same as UV-1 used in Example 1

U-2: Same as UV-2 used in Example 1

U-3: Same as UV-3 used in Example 1

U-4: Same as UV-4 used in Example 1

U-5: Same as UV-5 used in Example 1

EX-1: Same as ExM-9 used in Example 1

EX-2: Same as ExC-2 used in Example 1

EX-3: Same as ExC-4 used in Example 1

EX-4: Same as ExC-7 used in Example 1

EX-5: Same as Cpd-1 used in Example 1

EX-6: Same as ExM-8 used in Example 1, except that the average molecular weight was 30,000

EX-7: Same as ExM-12 used in Example 1

EX-8: Same as ExY-13 used in Example 1

EX-9: Same as ExY-15 used in Example 1

EX-10: Same as ExC-16 used in Example 1, except that R was $$\begin{array}{l} SCHCOOCH_3. \\ \quad\;\; | \\ \quad\;\; CH_3 \end{array}$$

EX-11: Same as ExM-9 used in Example 1, except that R was H.

EX-12:

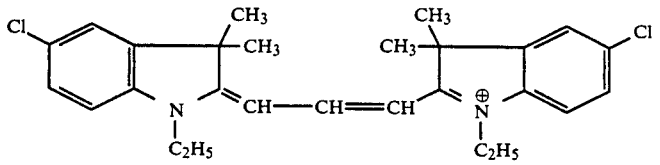

S-1: Same as Cpd-5 used in Example 1

S-2: Same as Cpd-6 used in Example 1

HBS-1: Tricresyl phosphate

HBS-2: Dibutyl phthalate

HBS-3: Bis(2-ethylhexyl) phthalate

HBS-4: Same as Solv-4 used in Example 1

H-1: Same as H-1 used in Example 1

Sensitizing Dye I

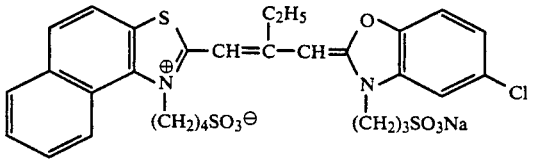

Sensitizing Dye II

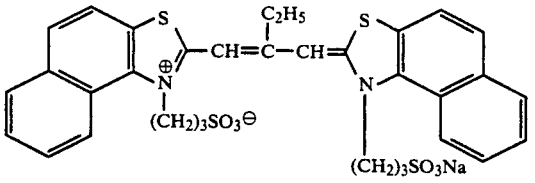

Sensitizing Dye III

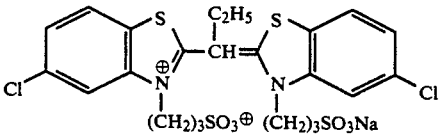

Sensitizing Dye IV

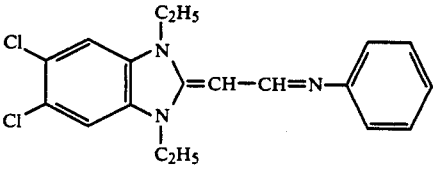

Sensitizing Dye V

-continued

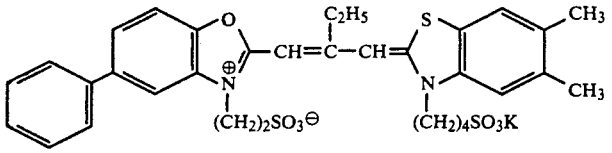

Sensitizing Dye VI

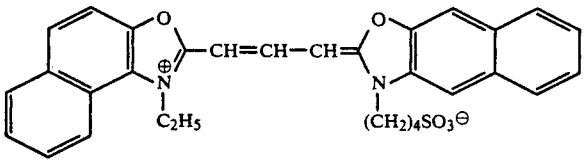

Sensitizing Dye VI

Sensitizing Dye VII

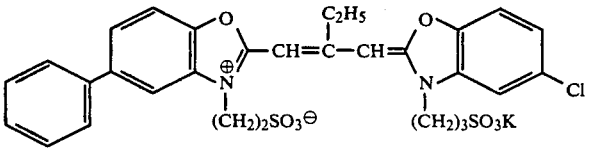

Sensitizing Dye VIII

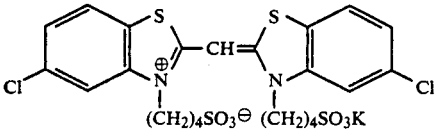

Sensitizing Dye IX

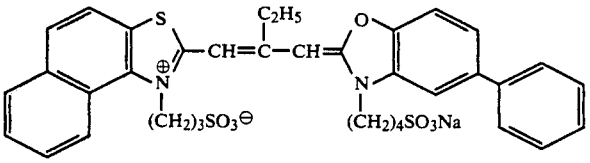

Light-sensitive material B thus-prepared was exposed in an exposure amount of 2.5 CMS using a light source having color temperature of 4800° K. and then subjected to development processing according to the processing steps shown below. To the bleaching solution and the bleach-fixing solution were added the bleach accelerating agent as shown in Table 2 above in an amount of $5\times10^{-3}$ mol per liter of the solution, respectively. The same test of desilveration as in Example 3 was carried out. The results was similar to those obtained in Example 3.

| Processing Step | Processing Time | Processing Temperature |
|---|---|---|
| Color Development | 2 min. 30 sec. | 40° C. |
| Bleaching | 30 sec. | 38° C. |
| Bleach-Fixing | 1 min. | 38° C. |
| Washing with Water | 1 min. | 38° C. |
| Stabilizing | 30 sec. | 38° C. |
| Drying | 1 min. | 60° C. |

The composition of each processing solution used is illustrated below.

Color Developing Solution

Same as described in Example 1.

Bleaching Solution

| | |
|---|---|
| Ammonium Iron (III) Ethylenediaminetetra-acetate Dihydrate | 120 g |
| Disodium Ethylenediaminetetraacetate | 10.0 g |
| Ammonium Bromide | 100.0 g |
| Ammonium Nitrate | 10.0 g |
| Aqueous Ammonia (27% weight/weight) | 15.0 ml |
| Water to make | 1.0 l |
| pH | 6.3 |

Bleach-Fixing Solution

| | |
|---|---|
| Ammonium Iron (III) Ethylenediaminetetra-acetate Dihydrate | 50.0 g |
| Disodium Ethylenediaminetetraacetate | 5.0 g |
| Sodium Sulfite | 12.0 g |
| Aqueous Solution of Ammonium Thiosulfate | 240.0 ml |
| Aqueous Ammonia (27% weight/weight) | 6.0 ml |
| Water to make | 1.0 l |
| pH | 7.2 |

Washing Water

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to prepare water containing not more than 3 mg/l of calcium ion and magnesium ion. To the water thus-treated were added sodium dichloroisocyanulate in an amount of 20 mg/l and sodium sulfate in an amount of 0.15 g/l. The pH of the solution was in a range from 6.5 to 7.5.

Stabilizing Solution

| | |
|---|---|
| Formalin (37 wt %) | 0.2 ml |
| Polyoxyethylene-p-monononylphenylether (average degree of polymerization: 10) | 0.3 g |
| Disodium ethylenediaminetetraacetate | 0.05 g |
| Water to make | 1.0 l |
| pH | 5.0 to 8.0 |

EXAMPLE 7

On a cellulose triacetate film support having a subbing layer, layers having the composition shown below were coated to prepare a multilayer color light-sensitive material which was designated light-sensitive material C.

| | |
|---|---|
| First Layer: Antihalation Layer | |
| Black colloidal silver | 0.25 g/m$^2$ |
| Ultraviolet Ray Absorbing Agent U-1 | 0.1 g/m$^2$ |
| Ultraviolet Ray Absorbing Agent U-2 | 0.1 g/m$^2$ |
| High Boiling Point Organic Solvent Oil-1 | 0.1 g/m$^2$ |
| Gelatin | 1.9 g/m$^2$ |
| Second Layer: Interlayer-1 | |
| Cpd-D | 10 mg/m$^2$ |
| High Boiling Point Organic Solvent Oil-3 | 40 mg/m$^2$ |
| Gelatin | 0.4 g/m$^2$ |
| Third Layer: Interlayer-2 | |
| Surface-fogged fine grain silver iodobromide emulsion (iodide content: 1 mol %, average particle diameter: 0.06 μm) | 0.05 g/m$^2$ (as silver) |
| Gelatin | 0.4 g/m$^2$ |
| Fourth Layer: First Red-Sensitive Emulsion Layer | |
| Silver iodobromide emulsion (a 1/1 mixture of a monodisporsed cubic emulsion having iodide content of 5 mol % and average particle diameter of 0.2 μm and a monodispersed cubic emulsion having iodide content of 5 mol % and average particle diameter of 0.1 μm) spectrally sensitized with Sensitizing Dye S-1 and Sensitizing Dye S-2 | 0.4 g/m$^2$ (as silver) |
| Coupler C-1 | 0.2 g/m$^2$ |
| Coupler C-2 | 0.05 g/m$^2$ |
| High Boiling Point Organic Solvent Oil-1 | 0.1 mg/m$^2$ |
| Gelatin | 0.8 g/m$^2$ |
| Fifth Layer: Second Red-Sensitive Emulsion Layer | |
| Silver iodobromide emulsion (monodispersed cubic emulsion having iodide content of 4 mol % and average particle diameter of 0.3 μm) spectrally sensitized with Sensitizing Dye S-1 and Sensitizing Dye S-2 | 0.4 g/m$^2$ (as silver) |
| Coupler C-1 | 0.2 g/m$^2$ |
| Coupler C-3 | 0.2 g/m$^2$ |
| Coupler C-2 | 0.05 g/m$^2$ |
| High Boiling Point Organic Solvent Oil-1 | 0.1 mg/m$^2$ |
| Gelatin | 0.8 g/m$^2$ |
| Sixth Layer: Third Red-Sensitive Emulsion Layer | |
| Silver iodobromide emulsion (monodisporsed cubic emulsion having iodide content of 2 mol % and average particle diameter of 0.4 μm) spectrally sensitized with Sensitizing Dye S-1 and Sensitizing Dye S-2 | 0.4 g/m$^2$ (as silver) |
| Coupler C-3 | 0.7 g/m$^2$ |
| Gelatin | 1.1 g/m$^2$ |
| Seventh Layer: Interlayer-3 | |
| Dye D-1 | 0.02 g/m$^2$ |
| Gelatin | 0.6 g/m$^2$ |
| Eight Layer: Interlayer-4 | |
| Surface-fogged, fine grain silver iodobromide emulsion (iodide content: 1 mol %, average particle diameter: 0.06 μm) | 0.05 g/m$^2$ (as silver) |
| Cpd-A | 0.2 g/m$^2$ |
| Gelatin | 1.0 g/m$^2$ |
| Ninth Layer: First Green-Sensitive Emulsion Layer | |
| Silver iodobromide emulsion (a 1/1 mixture of a monodisporsed cubic emulsion having iodide content of 5 mol % and average particle diameter of 0.2 μm and a monodispersed cubic emulsion having iodide content of 5 mol % and average particle diameter of 0.1 μm) spectrally sensitized with Sensitizing Dye S-3 and Sensitizing Dye S-4 | 0.5 g/m$^2$ (as silver) |
| Coupler C-4 | 0.3 g/m$^2$ |
| Cpd-B | 0.03 g/m$^2$ |
| Gelatin | 0.5 g/m$^2$ |
| Tenth Layer: Second Green-Sensitive Emulsion Layer | |
| Silver iodobromide emulsion (monodispersed cubic emulsion having iodide content of 5 mol % and average particle diameter of 0.4 μm) spectrally sensitized with Sensitizing Dye S-3 and Sensitizing Dye S-4 | 0.4 g/m$^2$ (as silver) |
| Coupler C-4 | 0.3 g/m$^2$ |
| Cpd-B | 0.03 g/m$^2$ |
| Gelatin | 0.6 g/m$^2$ |
| Eleventh Layer: Third Green-Sensitive Emulsion Layer | |
| Silver iodobromide emulsion (tabular emulsion having iodide content of 2 mol %, average particle diameter of 0.5 μm and aspect ratio of 5) | 0.5 g/m$^2$ (as silver) |
| Coupler C-4 | 0.8 g/m$^2$ |
| Cpd-B | 0.08 g/m$^2$ |
| Gelatin | 1.0 g/m$^2$ |
| Twelfth Layer: Interlayer-5 | |
| Dye D-2 | 0.05 g/m$^2$ |
| Gelatin | 0.6 g/m$^2$ |
| Thirteenth Layer: Yellow Filter Layer | |
| Yellow Colloidal Silver | 0.1 g/m$^2$ |
| Cpd-A | 0.01 g/m$^2$ |
| Gelatin | 1.1 g/m$^2$ |
| Fourteenth Layer: First Blue-Sensitive Emulsion Layer | |
| Silver iodobromide emulsion (a 1/1 mixture of a monodispersed cubic emulsion having iodide content of 3 mol % and average particle diameter of 0.2 μm and a monodispersed cubic emulsion having iodide content of 3 mol % and average particle diameter of 0.1 μm) spectrally sensitized with Sensitizing Dye S-5 and Sensitizing Dye S-6 | 0.6 g/m$^2$ (as silver) |
| Coupler C-5 | 0.6 g/m$^2$ |
| Gelatin | 0.8 g/m$^2$ |
| Fifteen Layer: Second Blue-Sensitive Emulsion Layer | |
| Silver iodobromide emulsion (tabular emulsion having iodide content of 2 mol %, average particle diameter of 0.5 μm and aspect ratio of 7) spectrally sensitized with Sensitizing Dye S-7 and Sensitizing Dye S-8 | 0.4 g/m$^2$ (as silver) |
| Coupler C-5 | 0.3 g/m$^2$ |
| Coupler C-6 | 0.3 g/m$^2$ |
| Gelatin | 0.9 g/m$^2$ |
| Sixteenth Layer: Third Blue-Sensitive Emulsion Layer | |
| Silver iodobromide emulsion (tabular emulsion having iodide content of | 0.4 g/m$^2$ (as silver) |

-continued

| | |
|---|---|
| 2 mol %, average particle diameter of 1.0 μm and aspect ratio of 7) spectrally sensitized with Sensitizing Dye S-7 and Sensitizing Dye S-8 | |
| Coupler C-6 | 0.7 g/m² |
| Gelatin | 11.2 g/m² |
| Seventeenth Layer: First Protective Layer | |
| Ultraviolet Ray Absorbing Agent U-1 | 0.04 g/m² |
| Ultraviolet Ray Absorbing Agent U-3 | 0.03 g/m² |
| Ultraviolet Ray Absorbing Agent U-4 | 0.03 g/m² |
| Ultraviolet Ray Absorbing Agent U-5 | 0.05 g/m² |
| Ultraviolet Ray Absorbing Agent U-6 | 0.05 g/m² |
| Cpd-B | 0.8 g/m² |
| Dye D-3 | 0.05 g/m² |
| Gelatin | 0.7 g/m² |
| Eighteenth Layer: Second Protective Layer | |
| Surface-fogged, fine grain silver iodobromide emulsion (iodide content: 1 mol %, average particle diameter 0.06 μm) | 0.1 g/m² (as silver) |
| Polymethyl methacrylate particles (average particle diameter: 0.06 μm) | 0.1 g/m² |
| Copolymer of methyl methacrylate and acrylic acid (molar ratio; 4/6) (average particle diameter: 1.5 μm) | 0.1 g/m² |
| Silicon Oil | 0.03 g/m² |
| Fluorine-containing Surface Active Agent W-1 | 3 g/m² |
| Gelatin | 0.8 g/m² |

Gelatin hardener H-1 and a surface active agent were added to each of the layers in addition to the above described components.

The compounds employed for the preparation of Light-sensitive material C are illustrated below.

C-1

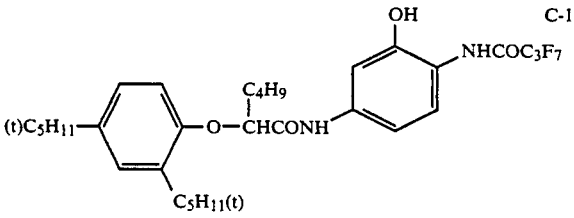

C-2

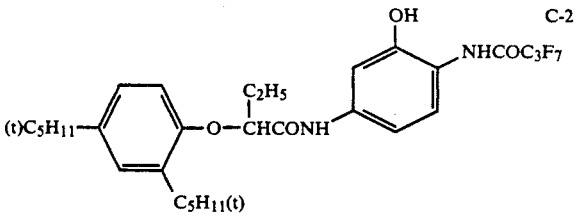

C-3

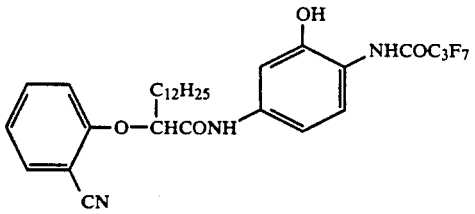

-continued

C-4

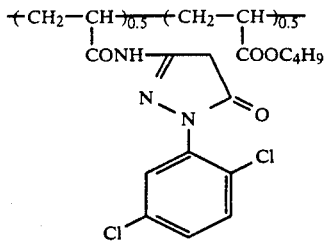

C-5

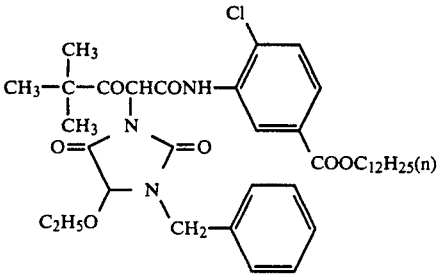

C-6

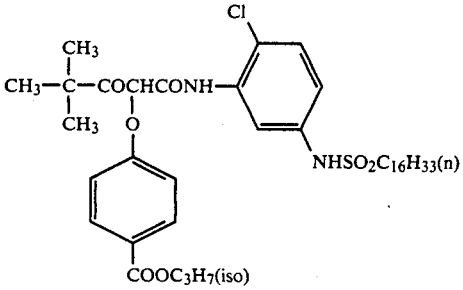

Oil-1: Dibutyl phthalate

Oil-2: Tricresyl phosphate

Oil-3:

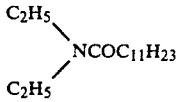

Cpd-A

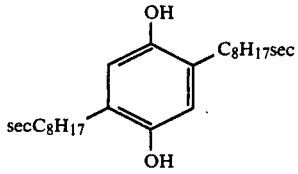

Cpd-B

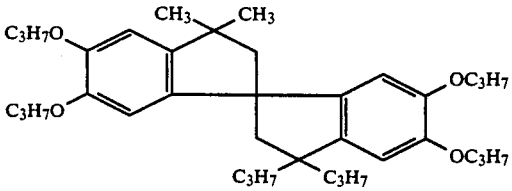

Cpd-C Same as Cpd-6 used in Example 1

Cpd-D

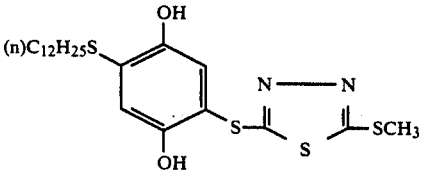

-continued

U-1

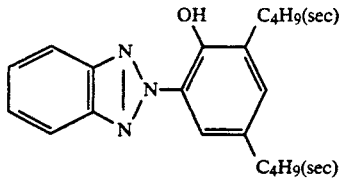

U-2

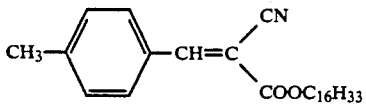

U-3: Same as UV-1 used in Example 1

U-4: Same as UV-2 used in Example 1

U-5: Same as UV-5 used in Example 1, except that R was $C_{12}H_{25}$

U-6: Same as UV-5 used in Example 1

S-1

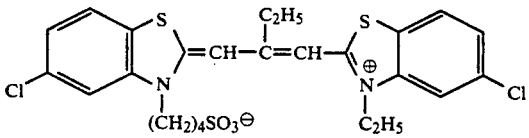

S-2

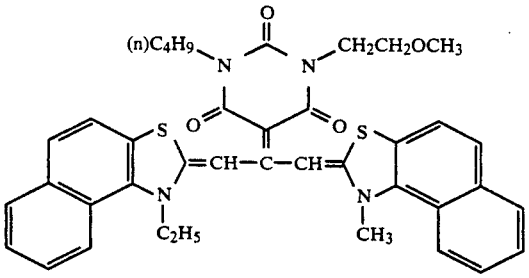

S-3

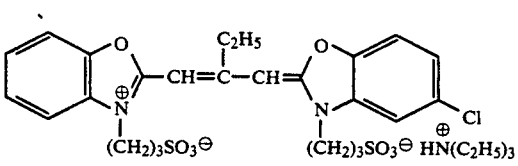

S-4

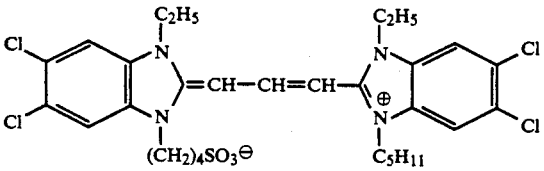

S-5

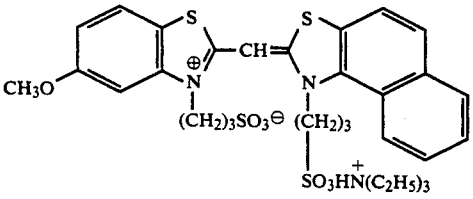

-continued

S-6

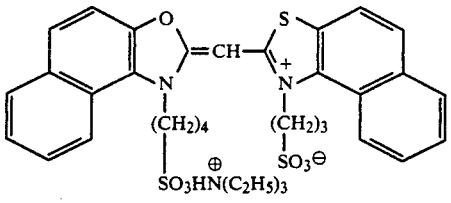

D-1

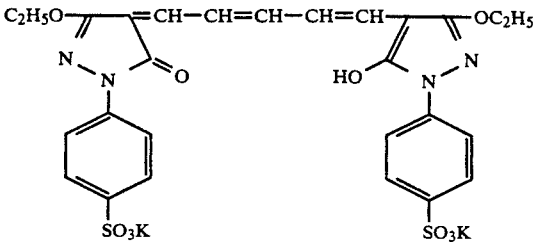

D-2

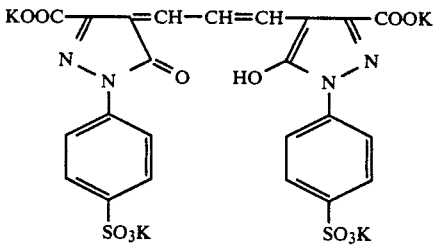

D-3

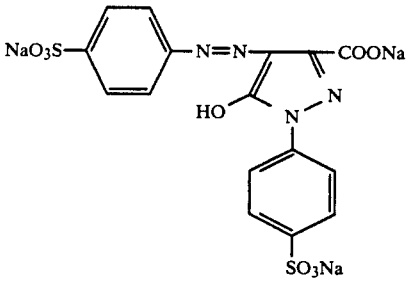

H-1: Same as H-1 used in Example 1

W-1

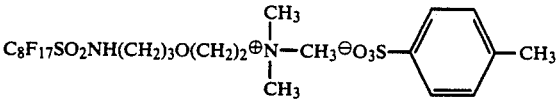

Light-sensitive material C thus-prepared was exposed in an exposure amount of 10 CMS using a light source having a color temperature of 4800° K., and then subjected to development processing according to the processing steps shown below. To the bleach-fixing solution were added the bleach accelerating property of these compounds were compared.

| Processing Step | Processing Time | Processing Temperature |
|---|---|---|
| First Development | 6 min. | 38° C. |
| First Washing with Water | 45 sec. | 38° C. |
| Reversal | 45 sec. | 38° C. |
| Color Development | 6 min. | 38° C. |
| Bleach-Fixing | 4 min. | 38° C. |
| Second Washing with Water (1) | 1 min. | 38° C. |
| Second Washing with Water (2) | 1 min. | 38° C. |
| Stabilizing | 1 min. | 25° C. |

-continued

| Processing Step | Processing Time | Processing Temperature |
|---|---|---|
| Drying | 2 min. | 50° C. |

The composition of each processing solution used is illustrated below.

First Developing Solution

| | |
|---|---|
| Pentasodium Nitrilo-N,N,N-trimethylenephosphonate | 2.0 g |
| Sodium Sulfite | 30 g |
| Potassium Hydroquinone Monosulfonate | 20 g |
| Potassium Carbonate | 33 g |
| 1-Phenyl-4-methyl-4-hydroxymethyl-3-pyrazolidone | 2.0 g |
| Potassium Bromide | 2.5 g |
| Potassium Thiocyanate | 1.2 g |
| Potassium Iodide | 2.0 mg |
| Water to make | 1.0 l |
| pH | 9.60 |

The pH was adjusted with hydrochloric acid or potassium hydroxide.

First Water Washing Solution

| | |
|---|---|
| Ethylene diaminetetramethylenephosphoric Acid | 2.0 g |
| Disodium Phosphate | 5.0 g |
| Water to make | 1.0 l |
| pH | 7.00 |

The pH was adjusted with hydrochloric acid or sodium hydroxide.

Reversal Solution

| | |
|---|---|
| Pentasodium Nitrilo-N,N,N-trimethylenephosphonate | 3.0 g |
| Stannous Chloride (dihydrate) | 1.0 g |
| p-Aminophenol | 0.1 g |
| Sodium Hydroxide | 8 g |
| Glacial Acetic Acid | 15 ml |
| Water to make | 1.0 l |
| pH | 6.00 |

The pH was adjusted with hydrochloric acid or sodium hydroxide.

Color Developing Solution

| | |
|---|---|
| Pentasodium Nitrilo-N,N,N-trimethylenephosphonate | 2.0 g |
| Sodium Sulfite | 7.0 g |
| Sodium Tertiary Phosphate (12 hydrate) | 36 g |
| Potassium Bromide | 1.0 g |
| Potassium Iodide | 90 mg |
| Sodium Hydroxide | 3.0 g |
| Citrazinic Acid | 1.5 g |
| E-Ethyl-N-(β-methanesulfonamidoethyl)-3-methyl-4-aminoaniline Sulfate | 11 g |
| 3,6-Dithiaoctan-1,8-diol | 1.0 g |
| Water to make | 1.0 l |
| pH | 11.80 |

The pH was adjusted with hydrochloric acid or sodium hydroxide.

Bleach-Fixing Solution

| | |
|---|---|
| Ammonium Iron (III) Ethylenediaminetetraacetate Dihydroate | 80 g |
| Disodium ethylenediaminetetraacetate Dihydrate | 5.0 g |
| Ammonium Thiosulfate (700 g/l aqueous solution) | 240 ml |
| Sodium Sulfite | 12.0 g |
| Bleach Accelerating Agent (as shown in Table 4 below) | |
| Water to make | 1.0 l |
| pH | 6.60 |

The pH was adjusted with hydrochloric acid or sodium hydroxide.

Second Water Washing Solution

City (tap) water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to prepare water containing not more than 3 mg/l of calcium ion and magnesium ion. To the water thus-treated were added sodium dichloroisocyanulate in an amount of 20 mg/l and sodium sulfate in an amount of 0.15 g/l. The pH of the solution was in a range from 6.5 to 7.5.

Stabilizing Solution

| | |
|---|---|
| Formalin (37 wt %) | 5.0 ml |
| Polyoxyethylene-p-monononylphenylether (average degree of polymerization: 10) | 0.5 g |
| Water to make | 1.0 l |
| pH | 6.60 |

The pH was not adjusted.

TABLE 4

| Run No. | Bleach* Accelerating Agent | Amount of Remaining Silver ($\mu g/cm^2$) | Remark |
|---|---|---|---|
| 57 | — | 52.0 | Comparison |
| 58 | (A) | 15.0 | " |
| 59 | (B) | 17.0 | " |
| 60 | (C) | 19.8 | " |
| 61 | (3) | 10.2 | Present Invention |
| 62 | (6) | 9.8 | " |
| 63 | (19) | 7.0 | " |
| 64 | (21) | 8.0 | " |
| 65 | (32) | 5.2 | " |
| 66 | (38) | 5.5 | " |
| 67 | (40) | 5.5 | " |
| 68 | (42) | 5.3 | " |

*Amount added: $5 \times 10^{-3}$ mol per liter of the bleach-fixing solution.

The amount of remaining silver after the above-described processing was determined by X-ray fluorometric analysis. The results thus-obtained are shown in Table 4 above. From these results, it is apparent that the compounds according to the present invention exhibit a very large bleach accelerating ability in the bleach-fixing of a reversal color film.

EXAMPLE 8

The same test as described in Example 7 was conducted except for using the following processing steps and processing solutions.

| Processing Step | Processing Time | Processing Temperature |
|---|---|---|
| First Development | 6 min. | 38° C. |
| First Washing with Water | 45 sec. | 38° C. |
| Reversal | 45 sec. | 38° C. |
| Color Development | 6 min. | 38° C. |
| Bleaching Accelerating | 45 sec. | 38° C. |
| Bleaching | 1 min. | 38° C. |
| Second Washing with Water | 45 sec. | 38° C. |
| Fixing | 3 min. | 38° C. |
| Third Washing with Water | 2 min. | 38° C. |
| Stabilizing | 1 min. | 38° C. |
| Drying | 2 min. | 50° C. |

First Developing Solution: Same as described in Example 7

First Washing with Water Solution: Same as described in Example 7

Reversal Solution: Same as described in Example 7

Color Developing Solution: Same as described in Example 7

Fixing Solution: Same as described in Example 7

Stabilizing Solution: Same as described in Example 7

Second Washing with Water Solution: Same as Second Washing with Water Solution described in Example 7.

Third Washing with Water Solution: Same as SEcond Washing with Water Solution described in Example 7.

Bleach Accelerating Solution

| | |
|---|---|
| Disodium Ethylenediaminetetraacetate | 3.0 g |
| Bleach Accelerating Agent (as shown in Table 5 below) | |
| Water to make | 1.0 l |
| pH | 4.5 |

Bleaching Solution

| | |
|---|---|
| Potassium Persulfate | 33 g |
| Sodium Chloride | 18 g |
| Monosodium Phosphate | 7.0 g |
| Phosphoric Acid (85% weight/weight) | 14.7 g |
| Water to make | 1.0 l |
| pH | |

The results obtained are shown in Table 5 below.

TABLE 5

| Run No. | Bleach* Accelerating Agent | Amount of Remaining Silver ($\mu g/cm^2$) | Remarks |
|---|---|---|---|
| 69 | — | 103.5 | Comparison |
| 70 | (A) | 20.5 | " |
| 71 | (B) | 22.5 | " |
| 72 | (C) | 28.0 | " |
| 73 | (10) | 9.9 | Present Invention |
| 74 | (18) | 8.1 | " |
| 75 | (34) | 6.0 | " |
| 76 | (37) | 6.5 | " |

*Amount added: $5 \times 10^{-3}$ mol l/l

As is apparent from the results shown in Table 5, the compounds according to the present invention exhibit a very large bleach accelerating ability in processing using a persulfate type bleaching solution.

EXAMPLE 9

Light-sensitive material A prepared in Example 1 was cut into a 35 m/m width strip, imagewise exposed to light under the condition of ISO 100, and then subjected to running processing according to the processing steps shown below with the processing solutions described below. The bleach-fixing solutions used and the contained the bleach accelerating agents were described in Table 6 below respectively. Before the running processing, the desilvering property of the processing solution just after the preparation was evaluated according to the same method as described in Example 1.

| Processing Step | Processing Time | Processing Temperature | Capacity of Tank | Amount of* Replenishment |
|---|---|---|---|---|
| Color Development | 2 min. 30 sec. | 40° C. | 8 l | 45 ml |
| Bleach-Fixing (1) | 1 min. 20 sec. | 40° C. | 4 l | ** |
| Bleach-Fixing (2) | 40 sec. | 40° C. | 2 l | 25 ml |
| Washing with Water (1) | 40 sec | 40° C. | 2 l | ** |
| Washing with Water (2) | 1 min. 00 sec. | 35° C. | 4 l | 20 ml |
| Stabilizing | 40 sec. | 35° C. | 2 l | 20 ml |

*Amount of replenishment per 1 meter of 35 m/m width strip

**The bleach-fixing steps (1) and (2) and washing with water steps (1) and (2) were conducted using a two-stage counter-current system from (2) to (1), respectively.

The composition of each processing solution used is illustrated below.

Color Developing Solution

| | Mother Liquor | Replenisher |
|---|---|---|
| Diethylenetriaminepentaacetic acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 t | 32.0 g |
| Potassium bromide | 1.4 g | 0.7 g |
| Potassium iodide | 1.3 mg | — |
| Hydroxylamine sulfate | 2.4 g | 2.6 g |
| 4-(N-Ethyl-N-β-hydroxyethylamino)-2-methylaniline sulfate | 4.5 g | 5.0 g |
| Water to make | 1.0 l | 1.0 l |
| pH | 10.00 | 10.05 |

Bleach-Fixing Solution

| | Mother Liquor | Replenisher |
|---|---|---|
| Ammonium thiosulfate (700 g/l aqueous solution) | 240 ml | 260 ml |
| Sodium sulfite | 18 g | 20 g |
| Ammonium iron (III) ethylenediaminetetraacetate dihydrate | 90 g | 100 g |
| Disodium ethylenediaminetetraacetate dihydrate | 9.0 g | 10.0 g |
| Bleach accelerating agent | (shown in table 7 below) | |
| Water to make | 1.0 l | 1.0 l |
| pH | 6.5 | 6.0 |

Washing Water

City (tap) water was passed through a column filled with an ion exchange resin (Amberlite MB-3 manufactured by Organo Co.) to form water having water quality shown below. Then, 0.02 g/l of sodium dichloroisocyanulate was added thereto.

| | |
|---|---|
| Calcium | not more than 1 mg/l |
| Magnesium | not more than 0.5 mg/l |
| pH | 6.5 to 7.3 |

Stabilizing Solution

| | Mother Liquor | Replenisher |
|---|---|---|
| Formalin (37 wt %) | 2.0 ml | 3.0 ml |
| Polyoxyethylene-p-monononylphenyl-ether (average degree of polymerization: 10) | 0.3 g | 0.45 g |
| Water to make | 1.0 l | 1.0 l |

The amount of processing was 30 meters per day and the processing was conducted continuously for 6 days. After stopping processing for one day, the desilvering property of the processing solution was evaluated again according to the same method as described in Example 1. The results thus-obtained are shown in Table 6 below.

TABLE 6

| Run No. | Bleach* Accelerating Agent | Amount of Remaining Silver Before Running ($\mu g/cm^2$) | Amount of Remaining Silver After Running ($\mu g/cm^2$) | Remark |
|---|---|---|---|---|
| 77 | — | 25.8 | 24.6 | Comparison |
| 78 | (D) | 7.2 | 24.2 | " |
| 79 | (E) | 5.9 | 24.5 | " |
| 80 | (F) | 6.7 | 15.9 | " |
| 81 | (G) | 7.1 | 18.0 | " |
| 82 | (6) | 4.5 | 3.9 | Present Invention |
| 83 | (11) | 4.2 | 3.5 | " |
| 84 | (12) | 4.1 | 3.5 | " |
| 85 | (31) | 3.0 | 2.4 | " |
| 86 | (32) | 3.1 | 2.5 | " |
| 87 | (35) | 3.1 | 2.6 | " |

*Amount added: $5 \times 10^{-3}$ mol per liter of the bleach-fixing solution (both mother liquor and replenisher).

As is apparent from the results shown in Table 6 above, the compounds according to the present invention continuously exhibit excellent desilveration accelerating effects in the bleach-fixing solution.

EXAMPLE 10

On a cellulose triacetate film support having a subbing layer were coated layers having the compositions shown below to prepare a multilayer color light-sensitive material, which was designated Light-sensitive material D.

Regarding the compositions of the layers, coated amounts are shown in units of $g/cm^2$, coated amounts of silver halide and colloidal silver are shown by a silver coated amount in a unit of $g/m^2$, and those of sensitizing dyes are shown using a molar amount per mol of silver halide present in the same layer.

In the following, the coefficient of variation described below is a coefficient of variation as to particle diameter. The dispersion solvent means an organic solvent having a high boiling point for dispersing hydrophobic diffusion-resistant compounds contained in the layer.

| | |
|---|---|
| First Layer: Antihalation Layer | |
| Black colloidal silver | 0.2 |
| Gelatin | 1.0 |
| Ultraviolet Ray Absorbing Agent UV-1' | 0.1 |
| Ultraviolet Ray Absorbing Agent UV-2' | 0.1 |
| Ultraviolet Ray Absorbing Agent UV-3' | 0.1 |
| Dispersion Solvent Oil-1' | 0.02 |
| Second Layer: Interlayer | |
| Fine grain silver bromide (average particle diameter: 0.07 $\mu m$) | 0.15 |
| Gelatin | 1.0 |
| Third Layer: First Red-Sensitive Emulsion Layer | |
| Monodispersed silver iodobromide emulsion (silver iodide: 2 mol %, average particle diameter: 0.3 $\mu m$, coefficient of variation: 19%) | 1.5 |
| Gelatin | 0.9 |
| Sensitizing Dye S-A' | $2.0 \times 10^{-4}$ |
| Sensitizing Dye S-B' | $1.0 \times 10^{-4}$ |
| Sensitizing Dye S-C' | $0.3 \times 10^{-4}$ |
| Coupler Cp-1' | 0.5 |
| Coupler CC-1' | 0.2 |
| Coupler DIR-1' | 0.02 |
| Coupler DIR-2' | 0.01 |
| Dispersion Solvent Oil-1' | 0.1 |
| Dispersion Solvent Oil-2' | 0.1 |
| Fourth Layer: Second Red-Sensitive Emulsion Layer | |
| Monodispersed silver iodobromide emulsion (silver iodide: 5 mol %, average particle diameter: 0.7 $\mu m$, coefficient of variation: 18%) | 1.2 |
| Gelatin | 1.0 |
| Sensitizing Dye S-A' | $3.0 \times 10^{-4}$ |
| Sensitizing Dye S-B' | $1.5 \times 10^{-4}$ |
| Sensitizing Dye S-C' | $0.45 \times 10^{-4}$ |
| Coupler Cp-2' | 0.15 |
| Coupler Cp-3' | 0.05 |
| Coupler CC-1' | 0.03 |
| Coupler DIR-1' | 0.01 |
| Dispersion Solvent Oil-2' | 0.1 |
| Fifth Layer: Interlayer | |
| Gelatin | 1.0 |
| Compound Cpd-A' | 0.05 |
| Dispersion Solvent Oil-2' | 0.01 |
| Sixth Layer: First Green-Sensitive Emulsion Layer | |
| Monodispersed silver iodobromide emulsion (silver iodide: 3 mol %, average particle diameter: 0.3 $\mu m$, coefficient of variation: 19%) | 0.4 |
| Monodispersed silver iodobromide emulsion (silver iodide: 6 mol %, average particle diameter: 0.5 $\mu m$) | 0.8 |
| Gelatin | 1.0 |
| Sensitizing Dye S-D' | $1 \times 10^{-4}$ |
| Sensitizing Dye S-E' | $4 \times 10^{-4}$ |
| Sensitizing Dye S-F' | $1 \times 10^{-4}$ |
| Coupler Cp-4' | 0.4 |
| Coupler Cp-5' | 0.4 |
| Coupler CC-2' | 0.1 |
| Coupler DIR-3' | 0.05 |
| Coupler DIR-2' | 0.01 |
| Coupler DIR-3' | 0.05 |
| Dispersion Solvent, Oil-2' | 0.05 |
| Seventh Layer: Second Green-Sensitive Emulsion Layer | |
| Polydispersed silver iodobromide emulsion (silver iodide: 7 mol %, average particle diameter: 0.8 $\mu m$, coefficient of variation: 15%) | 0.9 |
| Gelatin | 0.9 |
| Sensitizing Dye S-D' | $0.7 \times 10^{-4}$ |
| Sensitizing Dye S-E' | $2.8 \times 10^{-4}$ |
| Sensitizing Dye S-F' | $0.7 \times 10^{-4}$ |
| Coupler Cp-5' | 0.15 |
| Coupler CC-2' | 0.05 |
| Coupler DIR-3' | 0.01 |
| Dispersion Solvent Oil-1' | 0.08 |

-continued

| | |
|---|---|
| Dispersion Solvent Oil-3' | 0.03 |
| Eighth Layer: Yellow Filter Layer: Antihalation Layer | |
| Yellow Colloidal Silver | 0.2 |
| Gelatin | 0.8 |
| Cpd-A' | 0.2 |
| Dispersion Solvent Oil-1' | 0.1 |
| Ninth Layer: First Blue-Sensitive Emulsion Layer | |
| Monodispersed silver iodobromide emulsion (silver iodide: 6 mol %, average particle diameter: 0.3 μm, coefficient of variation: 20%) | 0.4 |
| Monodispersed silver iodobromide emulsion (silver iodide: 5 mol %, average particle diameter: 0.6 μm, coefficient of variation: 17%) | 0.4 |
| Gelatin | 2.0 |
| Sensitizing Dye S-G' | $1 \times 10^{-4}$ |
| Sensitizing Dye S-H' | $1 \times 10^{-4}$ |
| Coupler Cp-6' | 0.9 |
| Coupler DIR-1' | 0.05 |
| Dispersion Solvent Oil-3' | 0.9 |
| Tenth Layer: Second Blue-Sensitive Emulsion Layer | |
| Monodispersed silver iodobromide emulsion (silver iodide: 8 mol %, average particle diameter: 1.5 μm, coefficient of variation: 14%) | 0.5 |
| Gelatin | 0.5 |
| Sensitizing Dye S-G' | $5 \times 10^{-5}$ |
| Sensitizing Dye S-H' | $1 \times 10^{-5}$ |
| Coupler Cp-6' | 0.2 |
| Coupler DIR-1' | 0.02 |
| Dispersion Solvent Oil-3' | 0.01 |
| Eleventh Layer: First Protective Layer | |
| Gelatin | 0.5 |
| Ultraviolet Ray Absorbing Agent UV-1' | 0.1 |
| Ultraviolet Ray Absorbing Agent UV-2' | 0.1 |
| Ultraviolet Ray Absorbing Agent UV-3' | 0.1 |
| Ultraviolet Ray Absorbing Agent UV-4' | 0.1 |

-continued

| | |
|---|---|
| Twelfth Layer: Second Protective Layer | |
| Fine grain silver bromide (average particle diameter: 0.07 μm) | 0.25 |
| Gelatin | 0.5 |
| Polymethyl methacrylate particles (diameter: 1.5 μm) | 0.2 |
| Formaldehyde deactivator Cpd-B' | 0.5 |

Surface active agent W-1' and Hardening agent H-1' was added to each of the layers in addition to the above described components.

The compounds employed for the preparation of Light-sensitive material D are illustrated below.

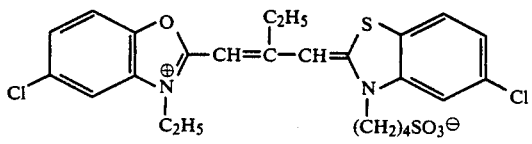

S-B': Same as Sensitizing Dye III used in Example 6

S-C': Same as Sensitizing Dye II used in Example 6

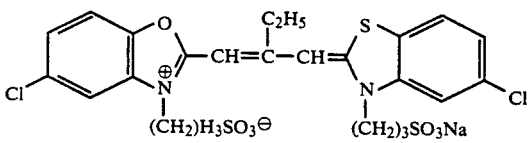

Cp-1': Same as ExC-1 used in Example 1, except $R_1$ was Cl and $R_2$ was CN.

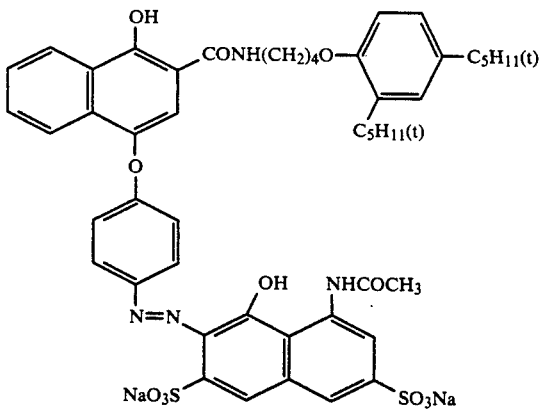

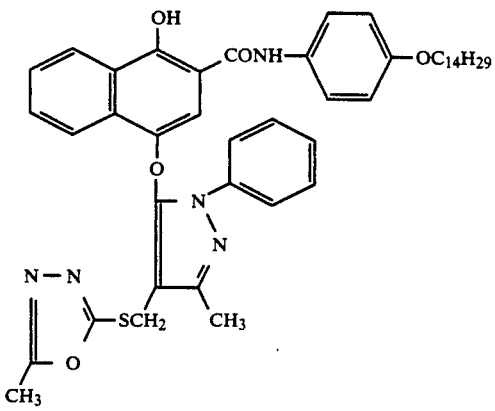

-continued
DIR-2'
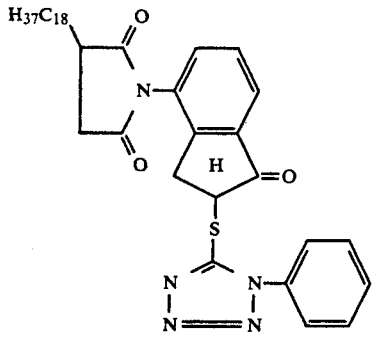
DIR-3'
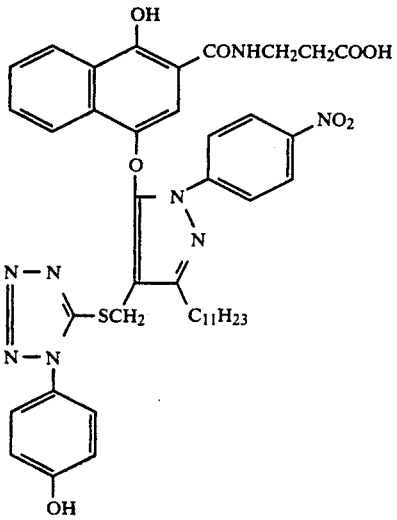
Cp-2'
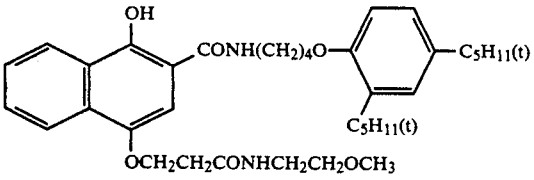
Cp-3'
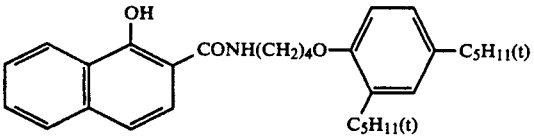
Cp-4'
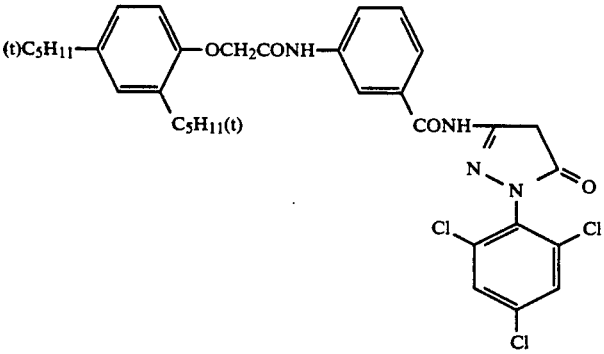

-continued
Cp-5'
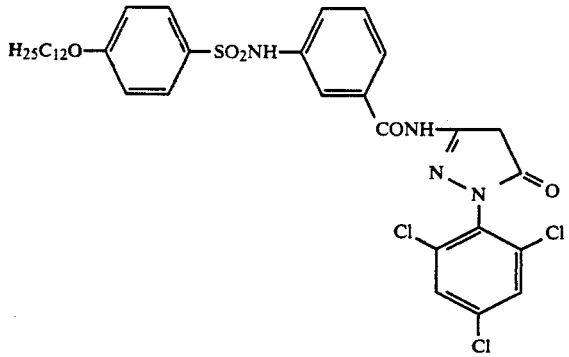
CC-2'
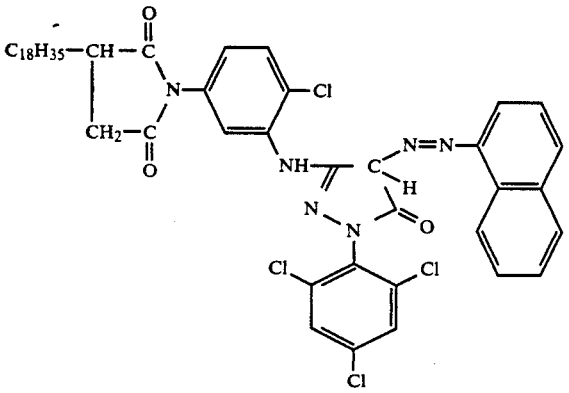
Cp-6'
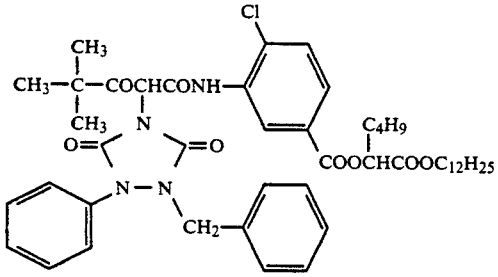
Oil-1': Same as Solv-3 used in Example 1
Oil-2': Same as Solv-1 used in Example 1
Oil-3'
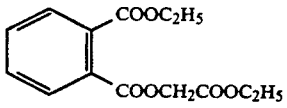
UV-1': Same as UV-2 used in Example 1
UV-2'
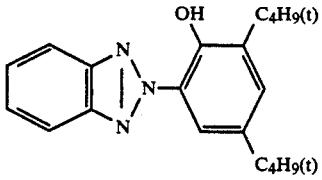
UV-3': Same as UV-1 used in Example 1
UV-4'
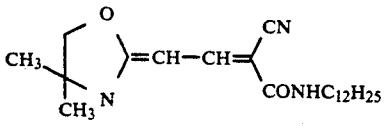
-continued
Cpd-A'
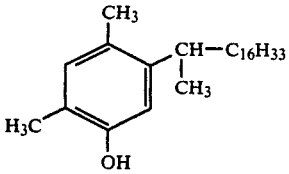
Cpd-B'
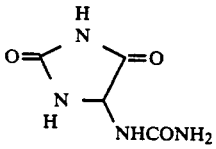
W-1'
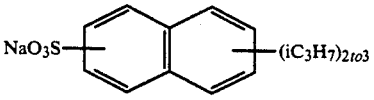
H-1'
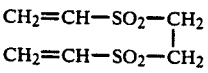

The same test as described in Example 3 was conducted using Light-sensitive material D thus-prepared in place of Light-sensitive material A, and similar results to those in Example 3 were obtained.

EXAMPLE 11

Using the processing solutions (Run Nos. 82 to 87) after conducting continuous processing according to the present invention described in Example 9, imagewise exposed light-sensitive materials shown below were processed. Desilveration was sufficiently performed and good photographic properties were obtained.

Super HR 100, Super HR 200, Super HR 400 and Super HR 1600 each manufactured by Fuji Photo Film Co., Ltd., SRV 100, SR 200, SR 400, SR 1600, GX 100, GX 400 and GX 3200 each manufactured by Konishiroku Photographic Industries, VRG 100, VR 200, VR 400, VR 1000 and VRG 400 each manufactured by Eastman Kodak Co., XRS 100, XR 200 and XR 400 each manufactured by Agfa Gevaert, and HR 100, HR 200 and HR 400 each manufactured by 3M.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising developing, followed by either bleaching in a bleaching solution or bleach-fixing in a bleach-fixing solution an imagewise exposed silver halide color photographic material, wherein at least one bleach-accelerating agent represented by formula (I) is contained in said bleaching solution, bleach-fixing solution or prebath thereof after color development in an amount of from $1\times10^{-5}$ to $1\times10^{-1}$ mol per liter of the processing solution, or is contained in said color photographic material:

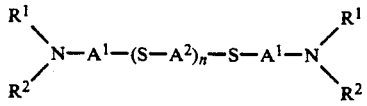

(I)

wherein $R^1$ and $R^2$, which may be the same or different, each represents a hydrogen atom or an unsubstituted alkyl group, or $R^1$ and $R^2$ may combine with each other to form a heterocyclic ring; $A^1$ and $A^2$, which may be the same or different, each represents an alkylene group having from 2 to 5 carbon atoms which may be substituted; and n represents an integer from 2 to 6.

2. A method for processing a silver halide color photographic material as claimed in claim 1, wherein said processing comprises color developing the imagewise exposed silver halide color photographic material followed by bleach-fixing.

3. A method for processing a silver halide color photographic material as claimed in claim 1, wherein the unsubstituted alkyl group has from 1 to 10 carbon atoms.

4. A method for processing a silver halide color photographic material as claimed in claim 1, wherein the alkylene group represented by $A^1$ or $A^2$ has from 2 to 4 carbon atoms.

5. A method for processing a silver halide color photographic material as claimed in claim 1, wherein a substituent for the substituted alkylene group represented by $A^1$ or $A^2$ is selected from a hydroxyl group, an amino group and a carboxy group.

6. A method for processing a silver halide color photographic material as claimed in claim 1, wherein n represents 2 or 3.

7. A method for processing a silver halide color photographic material as claimed in claim 1, wherein the bleach-accelerating agent represented by formula (I) is contained in an amount of from $1\times10^{-3}$ to $2\times10^{-2}$ mol per liter of the processing solution.

8. A method for processing a silver halide color photographic light-sensitive material as claimed in claim 1, wherein the bleach-accelerating agent represented by formula (I) is present in the color photographic light-sensitive material.

9. A method for processing a silver halide color photographic light-sensitive material as claimed in claim 8, wherein the bleach-accelerating agent represented by formula (I) is present in an amount of from $1\times10^{-4}$ to $1\times10^{-2}$ mol per $m^2$ of the color photographic material.

10. A method for processing a silver halide color photographic material as claimed in claim 1, wherein said silver halide color photographic material comprises a silver halide containing at least 1 mol % of silver iodide.

11. A method for processing a silver halide color photographic material as claimed in claim 1, wherein the at least one bleach-accelerating agent represented by formula (I) is contained in said bleaching solution or bleach-fixing solution.

12. A method for processing a silver halide color photographic material as claimed in claim 7, wherein the at least one bleach-accelerating agent represented by formula (I) is contained in an amount of from $2\times10^{-3}$ to $1\times10^{-2}$ mol per liter of the processing solution.

13. A method for processing a silver halide color photographic material as claimed in claim 1, wherein said prebath of the bleaching or bleach-fixing solution is a water washing bath or a bleach accelerating bath.

14. A method for processing a silver halide color photographic material as claimed in claim 1, wherein said prebath of the bleaching or bleach-fixing solution is a bleach accelerating bath.

* * * * *